US006962273B2

(12) United States Patent
Masuda

(10) Patent No.: US 6,962,273 B2
(45) Date of Patent: Nov. 8, 2005

(54) CYLINDER AND VALVE STRUCTURES FOR LIQUID-DISPENSING CONTAINERS

(76) Inventor: Masatoshi Masuda, 2, 9-banchi, Takada-Cho, Saiin, Ukyo-ku, Kyoto-city, Kyoto 615-0031 (JP)

( * ) Notice: Subject to any disclaimer, the term of this patent is extended or adjusted under 35 U.S.C. 154(b) by 236 days.

(21) Appl. No.: 10/443,236

(22) Filed: May 16, 2003

(65) Prior Publication Data

US 2003/0230600 A1 Dec. 18, 2003

(30) Foreign Application Priority Data

May 20, 2002 (JP) ..... 2002-144525

(51) Int. Cl.[7] ..... B65D 88/054

(52) U.S. Cl. ..... 222/321.9; 222/386; 222/321.8; 222/256

(58) Field of Search ..... 222/256, 257, 222/321.2, 321.8, 386–393, 321.9

(56) References Cited

U.S. PATENT DOCUMENTS

| | | | | |
|---|---|---|---|---|
| 3,187,960 | A * | 6/1965 | Gorman | 222/321.9 |
| 4,050,860 | A * | 9/1977 | Beres | 417/444 |
| 4,087,025 | A * | 5/1978 | Steiman | 222/321.9 |
| 5,002,207 | A * | 3/1991 | Giuffredi | 222/340 |
| 5,152,434 | A | 10/1992 | Birmelin | |
| 5,819,990 | A | 10/1998 | Cimentepe et al. | |
| 6,375,045 | B1 * | 4/2002 | Ki | 222/386 |
| 6,471,097 | B2 * | 10/2002 | Hermouet et al. | 222/321.2 |
| 2002/0166876 | A1 | 11/2002 | Masuda | |

FOREIGN PATENT DOCUMENTS

| | | |
|---|---|---|
| DE | 199 22 340 C 1 | 1/2001 |
| EP | 1 364 720 A2 | 11/2003 |
| JP | 2001-179139 | 7/2001 |
| JP | 2002-066401 | 3/2002 |
| KR | 20-0241101 | 7/2001 |

* cited by examiner

*Primary Examiner*—Michael Mar
*Assistant Examiner*—Melvin Cartagena
(74) *Attorney, Agent, or Firm*—Knobbe, Martens Olson & Bear, LLP

(57) ABSTRACT

A liquid-dispensing structure includes: an outer cylinder with a one-way valve at its lower end to allow a liquid to flow into the outer cylinder; a hollow piston being slidable inside the outer cylinder and having a pair of liquid-tight portions formed with circular convex portions around its outer circumferential surface in positions apart in an axial direction; and an inner cylinder for dispensing a liquid, which reciprocates inside the outer cylinder so that the piston moves in a piston-sliding area of the inner cylinder having an opening through which the liquid flows. The opening is closed when the piston is at a lower position and is opened when the piston is at an upper position.

13 Claims, 20 Drawing Sheets

CYLINDER AND VALVE STRUCTURES FOR LIQUID-DISPENSING CONTAINERS

BACKGROUND OF THE INVENTION

The present invention relates to a cylinder mechanism used for, for example, a fluid container such as a cosmetic container. Further, the present invention relates to a valve mechanism used for a container for a fluid or a liquid such as cosmetics.

As such cylinder mechanisms, conventionally, a mechanism using a cylinder filled with a fluid therein and a piston sliding inside the cylinder is used.

In the conventional cylinder mechanisms, it was difficult to reciprocate a piston smoothly while accomplishing sufficient liquidtightness. Additionally, to achieve a configuration in which a piston can be reciprocated smoothly while accomplishing liquidtightness, the piston needs to be manufactured with an extremely high degree of accuracy, which increases production costs.

For this reason, the use of a configuration for moving a piston smoothly while accomplishing high liquidtightness by providing an O-ring contacting an inner circumferential surface of a cylinder on an outer circumferential surface of the piston, can be considered.

If this configuration is adopted, however, the shaft core of the piston tilts against the shaft core of the cylinder when the direction of a stress to the piston and the direction of the shaft core of the piston are not accurately the same. After the tile occurs, the piston may not be reciprocated.

With regards to valve mechanisms, as described in Japanese Patent Laid-open No. 2001-179139, conventionally, a valve mechanism having a spherical valve body and a spring for giving momentum to the valve body toward a valve seat is used.

In the above-mentioned conventional valve mechanism, it is preferred that a size of a passage portion through which a liquid passes can be altered according to a coefficient of viscosity of a liquid passing therethrough. The conventional valve mechanism, however, has a problem in that it is difficult to alter a size of the liquid passage portion discretionally. Additionally, the above-mentioned conventional valve mechanism has another problem in that comprising all parts of the valve mechanism by molded resins is difficult.

Further, as in Japanese Patent Laid-open No. 2001-179139, conventionally, a valve mechanism having a spherical valve body and a spring for giving momentum to the valve body toward a valve seat is used. Manufacturing costs of the valve mechanism using the spherical valve body and the spring, however, tends to be high.

For this reason, a valve mechanism having a resinous valve seat and a resinous valve body moving between a closed position contacting the valve seat and an open position separating from the valve seat is commonly used.

This valve mechanism using the resinous valve seat and valve body has a configuration in which a liquidtight position is formed with the valve seat and the valve body making surface contact. Consequently, when the contact portions of both the valve seat and the valve body is not manufactured in high accuracy, high liquidtightness cannot be accomplished. To manufacture the contact portions of the valve seat and the valve body in high accuracy, manufacturing costs of the valve seat and the valve body increase.

SUMMARY OF THE INVENTION

The present invention has been achieved in light of the above-mention problems, and an embodiment of the invention aims at providing a cylinder mechanism of a fluid container by which a piston can be reciprocated smoothly with a small force while accomplishing sufficient liquidtightness. Further, in another embodiment, the present invention aims at providing a valve mechanism for which the use of molded resins is possible, low costs can be realized and a size of the passage portion can be altered easily according to the coefficient of viscosity of a liquid passing through. Additionally, in still another embodiment, while keeping manufacturing costs low, it aims to provide a valve mechanism of a liquid container, which can accomplish high liquidtightness.

More specifically, one aspect of this invention involves liquid-dispensing structures described below. Solely for the sake of easy understanding and convenience, numerals indicated in the figures are referred to when describing various embodiments, but the invention is not limited to the numerals and the figures and also is not limited to the embodiments.

In an embodiment, a liquid-dispensing structure comprises: (I) an outer cylinder (e.g., 23, 23') to be filled with a liquid, said outer cylinder having a one-way valve (e.g., 86) at its lower end to allow a liquid to flow into the outer cylinder; (II) a hollow piston (e.g., 83) provided inside the outer cylinder, said piston having a pair of liquid-tight portions (e.g., 114, 115) formed around its outer circumferential surface, each of which portions liquid-tightly contacts an inner circumferential surface (e.g., 85) of the outer cylinder, said pair of liquid-tight portions being arranged in positions apart in an axial direction of the outer cylinder, said liquid-tight portions being circular convex portions; and (III) an inner cylinder (e.g., 82) for dispensing the liquid, which reciprocates inside the outer cylinder in an axial direction of the inner cylinder which is co-axial with the outer cylinder, said inner cylinder having a piston-sliding area (e.g., S) where when the inner cylinder moves, the piston moves liquid-tightly with respect to the inner cylinder between a lower position and an upper position in the axial direction of the inner cylinder, said inner cylinder having an opening (e.g., 91) which is closed when the piston is at the lower position and which is opened when the piston is at the upper position wherein the liquid inside the outer cylinder flows into an inside of the inner cylinder through the opening.

The above structures may include, but are not limited to, the following various specific configurations:

One of the pair of liquid-tight portions (e.g., 114) may be provided at an upper end of the piston, and the other of the pair of liquid-tight portions (e.g., 115) may be provided at a lower end of the piston. Further, the liquid-tight portion at the upper end may be formed with two circular convex portions (e.g., 114), and the liquid-tight portions at the lower end may be formed with one circular convex portion (e.g., 115). The liquid-tight portion provided at the upper end may be formed with an annular lip (e.g., 112) extending upward, and the liquid-tight portion provided at the lower end may be formed with an annular lip (e.g., 113) extending downward.

Each liquid tight portion of the piston may have a diameter larger than that of the inner circumferential surface of the outer cylinder, and the liquid tight portion (e.g., 112, 113) maybe flexible inwardly.

The piston may have upper and lower circular convex portions (e.g., 131, 132) along an inner circumferential surface (e.g., 133) of the piston to close the opening (e.g., 91) of the inner cylinder, wherein the upper and lower circular convex portions are arranged to locate the opening of the inner cylinder therebetween.

The inner cylinder may have at least one circular convex portion (e.g., 1102, 1101) which is in contact liquid-tightly with the piston at the upper and lower positions in the piston-sliding area. In the above, the convex portion of the inner cylinder may have a U-shaped or V-shaped cross section.

Additionally, the one-way valve (e.g., 86) may comprise: (a) a lower surface (e.g., 85*a*, 85*a*") extending from the inner circumferential surface (e.g., 85) of the outer cylinder; (b) a central opening (e.g., 41, 41") provided in the lower surface; and (c) a valve body (e.g., 89, 89") movably placed in the central opening, said valve body comprising (i) a head portion (e.g., 54) provided inside the outer cylinder, said head portion having a larger diameter than the central opening and being fitted on the lower surface to close the opening when the valve body is at a lower position, and (ii) a restraining portion (e.g., 56) provided outside the outer cylinder, said restraining portion having a larger diameter than the central opening and having grooves (e.g., 58) to flow the liquid therethrough when the valve body is at an upper position.

In the above, the lower surface may have at least one circular convex portion (e.g., equivalent to 57) which is in contact liquid-tightly with the head portion of the valve body at the lower position. Alternatively or additionally, the head portion (e.g., 54) of the valve body may have a lower surface (e.g., 152) having at least one circular convex portion (e.g., 1104) which is in contact liquid-tightly with the lower surface.

In an embodiment, the one-way valve (e.g., 86) may comprise: (a) a lower surface (e.g., 85*a*') extending from the inner circumferential surface of the outer cylinder, said lower surface having at least one opening (e.g., 41'), through which the liquid flows; (b) a central tube body (e.g., 52) provided in the lower surface; and (c) a valve body (e.g., 89') movably placed in the tube body, said valve body comprising (i) a head portion (e.g., 54') provided inside the outer cylinder, said head portion being fitted on the lower surface to close the opening (e.g., 41') when the valve body is at a lower position, and (ii) a restraining portion (e.g., 56') provided outside the outer cylinder, said restraining portion having a larger diameter than the tube body to prevent the valve body from moving beyond an upper position.

In the above, the lower surface may have at least one circular convex portion (e.g., 57) which is in contact liquid-tightly with the head portion of the valve body at the lower position. Alternatively or additionally, the head portion of the valve body may have a lower surface (e.g., 152') having at least one circular convex portion (e.g., equivalent to 1104) which is in contact liquid-tightly with the lower surface.

In another embodiment, a liquid-dispensing structure may comprise: (a) an outer cylinder (e.g., 23') to be filled with a liquid, said outer cylinder having a one-way valve (e.g., 89') at its lower end to allow a liquid to flow into the outer cylinder; and (b) a piston (e.g., 83) provided with an inner cylinder (e.g., 82) inside the outer cylinder for dispensing the liquid, said one-way valve comprising: (I) a lower surface (e.g., 152') extending from an inner circumferential surface (e.g., 85) of the outer cylinder, said lower surface having at least one opening (e.g., 41'), through which the liquid flows; (II) a central tube body (e.g., 52) provided in the lower surface; and (III) a valve body (e.g., 89') movably placed in the tube body, said valve body comprising (i) a head portion (e.g., 54') provided inside the outer cylinder, said head portion being fitted on the lower surface to close the opening when the valve body is at a lower position, and (ii) a restraining portion (e.g., 56') provided outside the outer cylinder, said restraining portion having a larger diameter than the tube body to prevent the valve body from moving beyond an upper position. In the above, the lower surface may have at least one circular convex portion (e.g., 57) which is in contact liquid-tightly with the head portion of the valve body at the lower position. Alternatively or additionally, the head portion of the valve body may have a lower surface having at least one circular convex portion (e.g., equivalent to 1104) which is in contact liquid-tightly with the lower surface.

The present invention may also include a liquid container which may comprise a liquid dispenser (e.g., 1) provided with the liquid-dispensing structure of any of the forgoing, and a container body (e.g., 4) to which the liquid dispenser is attached. In the above, the container body may have a bottom (e.g., 16) liquid-tightly provided inside the container body, said bottom being slidable against an inner circumferential surface (e.g., 5) of the container body as inside pressure of the container body changes.

For purposes of summarizing the invention and the advantages achieved over the related art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

Figure 1:
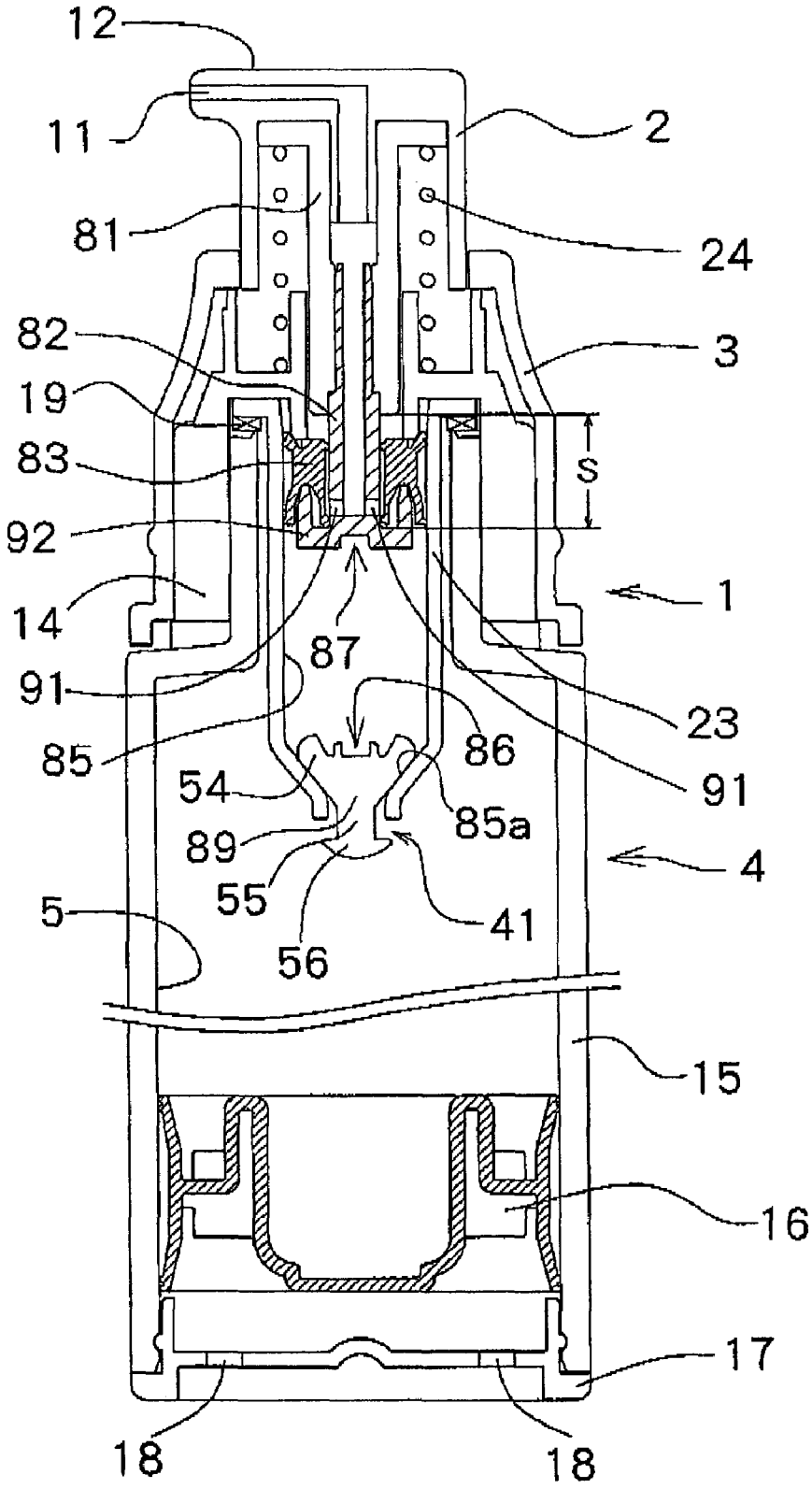
FIG. 1 is a schematic diagram illustrating a longitudinal section of a fluid container to which the cylinder mechanism according to an embodiment of the present invention applies.

Explanation of symbols used is as follows: 1: Fluid discharge pump; 2: Nozzle head: Outer lid; 4: Fluid storing portion; 11: Discharge portion; 12: Pressing portion 14: screw material; 15: First cylinder; 16: First piston; 17: Outer lid; 18: Air hole; 23: Second cylinder; 24: Coil spring; 41: Opening portion; 81: First coupling tube; 82: Second coupling tube; 83: Second piston; 86: First valve mechanism; 87: Second valve mechanism 89: Valve body; 91: Opening portion; 92: Convex portion.

Further, 23': Second cylinder; 41': Opening portion; 51: Bottom portion; 52: Cylinder portion; 53: Coupled portion; 54': Valve portion; 55': Guide portion; 56': Regulating portion ; 57: Protruding portion; 81': First coupling tube; 89': Valve body; 110: Lid material 111: Base; 112: Lid body; 113: Opening; 114: Closed portion; 115: Female screw portion 120: Valve body; 130: Cylindrical material; 133: Opening portion; 151: Bottom portion or tapered portion; 152: Cylindrical portion; 153: Coupled portion or Regulating portion; 154': Valve portion; 155': Guide portion; 156': Regulating portion; 157: Protruding portion.

Additionally, 23": Second cylinder; 41": Opening portion; 82: Second coupling tube 83: Second piston; 86: Valve mechanism; 87: Valve mechanism; 89": Valve body; 1101: Protruding portion; 1102: Protruding portion; 103: Protruding portion; 1104: Protruding portion; 201: Protruding portion; 300: Protrusion; 301: Protrusion.

DETAILED DESCRIPTION OF THE PREFERRED EMBODIMENT

The present invention can be achieved in various ways including, but not following embodiments, and any combination of elements and configurations can be used in the present invention.

In a first embodiment of the present invention, a cylinder mechanism of a comprises a cylinder filled with a fluid inside it and a piston reciprocating inside the cylinder, which is characterized in that, on an outer circumferential surface of the piston, a pair of liquidtight portions, each of which contacts an inner circumferential surface of the cylinder, are arranged in positions apart only by a certain distance and the contact portions in a pair of the liquidtight portions, which contact the inner circumferential surfaces of the cylinder, comprise a pair of convex portions arranged adjacently.

In a second embodiment, a cylinder mechanism of a fluid container comprises a cylinder filled with a fluid inside it and a piston reciprocating inside the cylinder, which is characterized in that, on an outer circumferential surface of the piston, a pair of liquidtight portions, each of which contacts an inner circumferential surface of the cylinder, are arranged in positions apart only by a certain distance and that, of a pair of the liquidtight portions, the contact portion of one liquidtight portion, which contacts the inner circumferential surface of the cylinder, comprises a pair of convex portions arranged adjacently, and the contact portion of the other liquidtight portion, which contacts the inner circumferential surface of the cylinder, comprises a single convex portion.

A third embodiment of the present invention is characterized by comprising: A cylindrical main unit with a bottom, which has an opening portion at its bottom; a cylindrical portion having an external form smaller than the internal diameter of the opening portion at the main unit; a valve seat having a coupled portion, which couples the main unit and the cylindrical portion for fixing the cylindrical portion within the opening portion; a valve body having a valve portion which closes the opening portion by contacting the bottom of the main unit and opens the opening portion by separating from the bottom of the main unit, a guide portion having an external form smaller than the internal diameter of the cylindrical portion and a length longer than that of the cylindrical portion, which, by being inserted inside the cylindrical portion, guides a movement between a position at the valve portion which contacts the bottom of the main unit and a position which separates from the bottom, and a regulating portion for preventing the guide portion from coming off form the cylindrical body. In the above, at the portion which contacts the valve body at the valve seat, a protruding portion may be formed, and the valve seat and the valve body may contact each other via the protruding portion.

In a fourth embodiment, a valve mechanism has a valve seat and a valve body which moves between a closed position contacting the valve seat and an open position separating from the valve seat, which is characterized in that by forming a circular protruding portion in either of the valve seat or the valve body, the valve seat and the valve body are contacted via the circular protruding portion. In the forgoing, the circular protruding portion may have a nearly V-shaped cross-section. In variations, the circular protruding portion may have a nearly U-shaped cross-section. Further, the circular protruding portion may have a configuration in which a circular protrusion is provided doubly.

Figure 2:
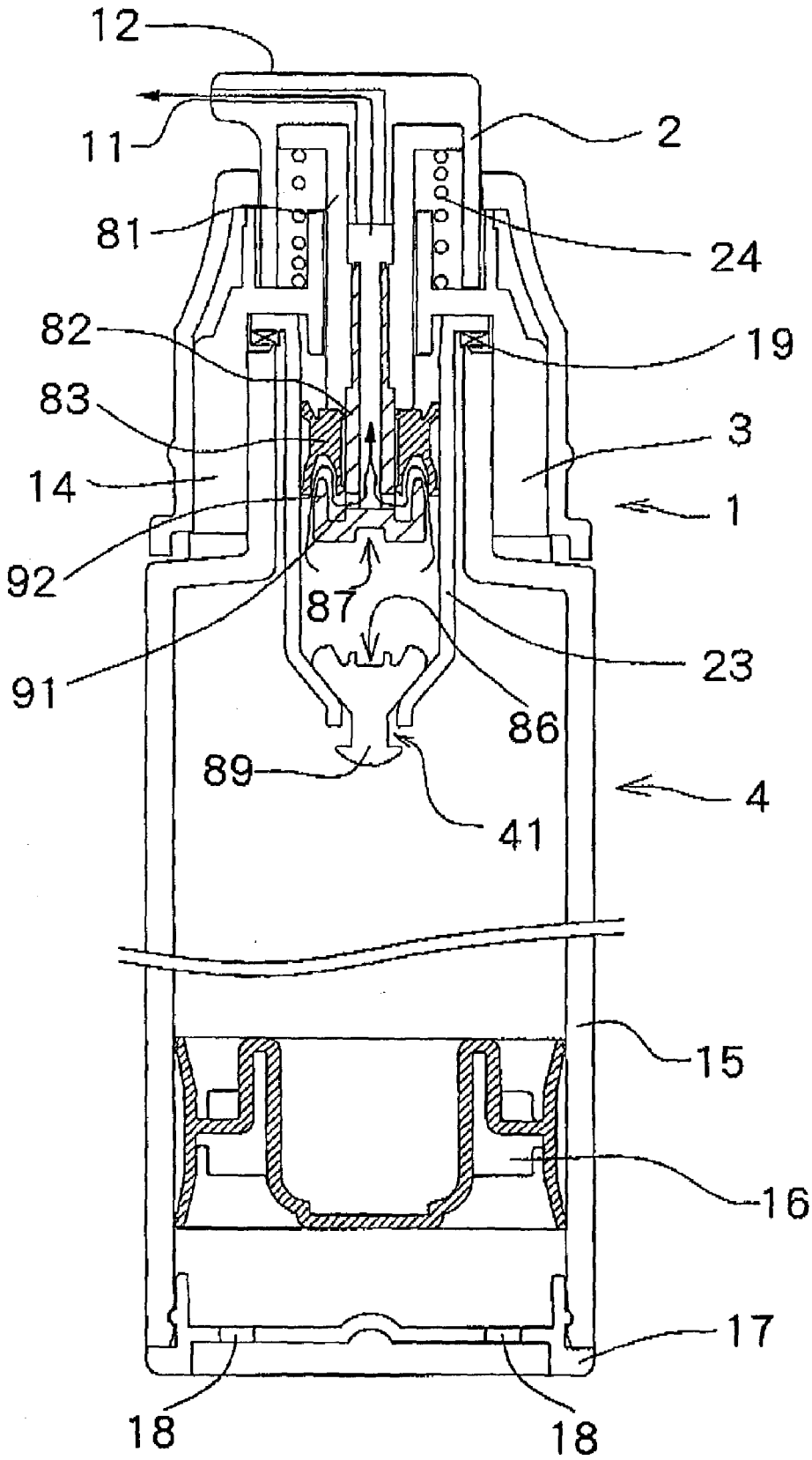
FIG. 2 is a schematic diagram illustrating a longitudinal section of a fluid container to which the cylinder mechanism according to an embodiment of the present invention applies.
Figure 3:
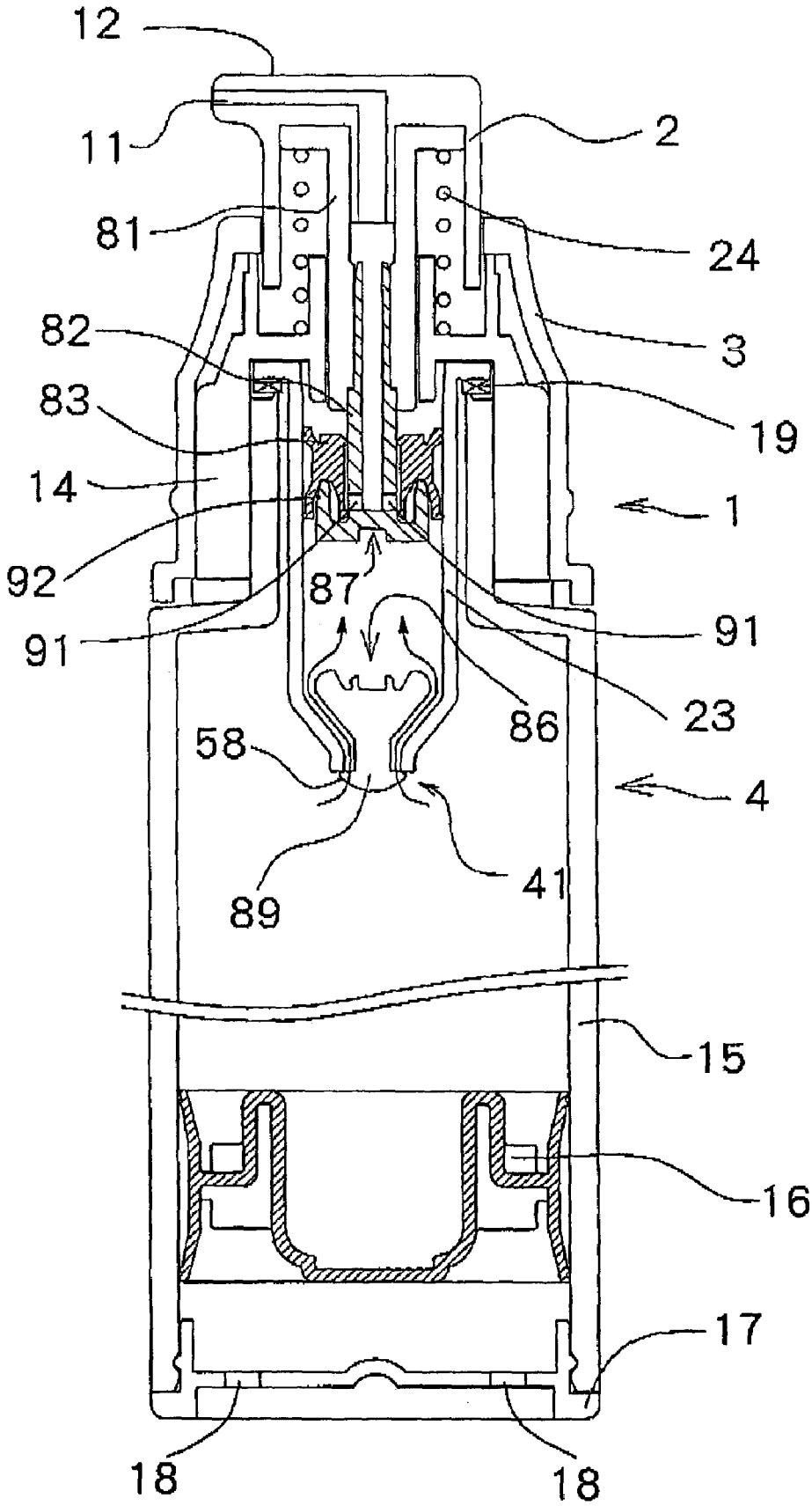
FIG. 3 is a schematic diagram illustrating a longitudinal section of a fluid container to which the cylinder mechanism according to an embodiment of the present invention applies.

The first and second embodiments are described by referring to figures. FIGS. 1 to 3 are longitudinal sections of a fluid container to which the cylinder mechanism according to the present invention applies.

Of the figures, FIG.1 position in which no stress is given to a fluid discharge pump 1 shows a position in which, with a pressing portion 1 at a nozzle head 2 being pressed, the first and the second coupling tubes 81 and 82 are descending along with the second piston 83. FIG. 3 shows with a pressure applied to the nozzle head being released, the first and the second coupling tubes 81 and 82 ascending along with the second piston 83. In FIG. 1 to FIG. 3, clearly demonstrate an opening portion 91, hatching is added only to the second coupling tube 82 respectively.

This fluid container is used as a container for beauty products for storing gels such as hair gels and cleansing gels or creams such as nourishing creams and cold creams or liquids such as skin toners used in the cosmetic field. Additionally, in this specification, high-viscosity liquids, semifluids, gels that sol solidifies to a jelly, and creams, and regular liquids, are all referred to as fluids.

This fluid container comprises a fluid discharge pump 1, a nozzle head 2, an outer lid 3 and a fluid storing portion 4 for storing a fluid inside it.

The nozzle head 2 has a discharge portion 11 for discharging a fluid and a pressing portion 12 to be pressed when the fluid is discharged. Additionally, the outer lid 3 is engaged with a screw portion formed at the top edge of the fluid storing portion 4 via a screw material 14.

The fluid storing portion 4 has the first cylinder 15 which is tubular, the first piston 16 which moves in upward and downward directions inside the first cylinder 15 and an outer lid 17 number of air holes 18 are provided. The first cylinder 15 and the fluid discharge pump 1 are connected by packing 19.

The first piston 16 configuration to move smoothly inside the first cylinder 15 while accomplishing high liquidtightness. The configuration of the first piston 16 is described later in detail.

In this fluid container, by pressing the pressing portion 12 at the nozzle head 2 to generate reciprocating motions in upward and downward directions, a fluid stored inside the fluid storing portion 4 is discharged from the discharge potion 11 at the nozzle head 2 by the action of the fluid discharge pump 1 which is described later in detail. As an amount of the fluid inside the fluid storing portion 4 reduces, the first piston 15 moves inside the first cylinder 15 toward the nozzle head 2.

In this specification, upward and downward directions in FIGS. 1 to 3 are defined as upward and downward directions in the fluid container. In other words, in the fluid container according to this embodiment, the side of the nozzle head 2 shown in FIG. 1 is defined as the upward direction, and the side of the first piston 16 is defined as the downward direction.

The configuration of the fluid discharge pump 1 is described below.

This fluid discharge pump 1 possesses: second cylinder 23; the second piston 83 which can reciprocate inside the second cylinder 23; the first and the second hollow coupling tubes 81 and 82 coupled and fixed with each other to form a coupling tube, which is used for sending down the second piston 83 by transmitting a pressure given to the nozzle head 2 to the second piston 83, by coupling the nozzle head 2 and the second piston 83; a coil spring 24 set up at the outer perimeter of the first and the second coupling tubes 81 and 82 for giving momentum to the second piston 83 in the direction of raising it; the first valve mechanism 86 for flowing a fluid stored in the fluid storing portion 4 into the second cylinder 23 as the second piston 83 ascends; the second valve mechanism 87 for letting the fluid flowed into the second cylinder 23 out to the nozzle head 2 through the first and the second coupling tubes 81 and 82 as the second piston 83 descends.

Similarly to the first piston 16, the second piston 83 mentioned above requires a configuration to move smoothly inside the second cylinder 23 while accomplishing high liquidtightness. The configuration of the second piston 83 is described later in detail.

For the coil spring 24 mentioned above, a metal coil spring is used to acquire strong momentum. Because this coil spring 24 is set up at the outer perimeter of the coupling tube 81, it does not contact the fluid passing through the inside of the coupling tube 81.

The above-mentioned the first valve mechanism 86 is used to close an opening portion 41 communicating with the fluid storing portion 4 formed in the vicinity of the lower end of the second cylinder 23 and the second cylinder 23 when a pressure is applied to inside the second cylinder 23, and to open the opening portion 41 when inside the second cylinder 23 is depressurized.

The first valve mechanism 86 has a tapered portion slanted by an angle equal to the angle of a tapered inner surface at the lower end of the second cylinder 23 and possesses a resinous valve body 89 having a stopper formed at its lower end. In this first valve mechanism 86, when inside the second cylinder 23 is pressurized, the opening portion 41 is closed with the tapered portion of the valve body 89 contacting an inner tapered portion at the lower end of the second cylinder 23 as shown in FIG. 2. When inside the second cylinder 23 is depressurized, the opening portion 41 is opened with the tapered portion of the valve body 89 separating from an inner tapered portion at the lower end of the second cylinder 23 as shown in FIG. 3. At this time, a traveling distance of the valve body 89 is controlled by the stopper formed at the lower end of the valve body 89 contacting the lower end of the second cylinder 23.

In the stopper formed at the lower end of the valve body 89, a notch portion (not shown in the figures) is formed. Consequently, as shown in FIG. 3, when the stopper contacts the lower end of the second cylinder 23, the configuration makes it possible that the fluid can flow in from the lower end of the opening portion of the second cylinder 23.

The above-mentioned second valve mechanism 87 is used to open a flow path communicating with inside the first and the second coupling tubes 81 and 82 and inside the second cylinder 23 by separating from the above-mentioned second piston 83 when the nozzle head 2 is pressed, and to close the flow path communicating with inside the first and the second coupling tubes 81 and 82 inside the second cylinder 23 by contacting the second piston 83 when a pressure to the nozzle head 2 is removed.

Down below the cylindrical portion of the second coupling tube 82, an opening portion 91 is provided Additionally, outside the opening portion 91, a convex portion 92 which can contact a concave portion formed in the second cylinder 23 is formed. As shown in FIG. 2, in a position in which the concave portion formed in the second cylinder 23 and the convex portion formed in the second coupling tube 82 are separated, a flow path leading to inside the first and the second coupling tubes 81 and 82 from inside the second cylinder 23 through the opening portion 91 is formed. As shown FIG. 1 and FIG. 3, in a position in which the concave portion formed in the second cylinder 23 and the convex portion formed in the second coupling tube 82 are contacted, a flow path leading to inside the first and the second coupling tubes 81 and 82 from inside the second cylinder 23 is closed.

Discharge motions of the fluid discharge container possessing the above-mentioned fluid discharge pump 1 are described below.

In an initial position, as shown in FIG. 1, momentum is given to the first and the second coupling tubes 81 and 82 coupled with each other in an upward direction by the action of the coil spring 24, and the convex portion 92 formed at the lower end of the second coupling tube 82 contacts the concave portion formed in the second piston 83. Consequently, a flow path leading to inside the first and the second coupling tubes 81 and 82 from inside the second cylinder 23 is closed. Additionally, by the empty weight of the valve body 89, the tapered portion of the valve body 89 contacts the inner tapered portion at the lower end of the second cylinder 23, closing the opening portion 41.

In this position, when the pressing portion 12 at the nozzle head 2 is pressed, as shown in FIG. 2, the first and the second coupling tubes 81 and 82 first descend relatively to the second piston 83. By this motion, the convex portion 92 formed at the lower end of the second coupling tube 82 separates from the concave potion formed in the second piston 83. Consequently, a flow path leading to inside the first and the second coupling tubes 81 and 82 from inside the second cylinder 23 through the opening 91 is formed.

If the pressing portion 12 at the nozzle head 2 is pressed further, the lower end of the second coupling tube 81 and the top of the second piston 83 are contacted, and the second piston 83 and the first and the second coupling tubes 81 and 82 descend all together. At this time, inside the second cylinder is pressurized, and the opening 41 is closed with the tapered portion of the valve body 89 contacting the inner tapered portion at the lower end of the second cylinder 23. Consequently, the pressurized fluid inside the second cylinder 23 flows out to the discharge portion 11 at the nozzle head 2 through the opening portion 91 and the first and the second hollow coupling tubes 81 and 82, and is discharged from the discharge portion 11.

After the second piston 83 descends to the lower limit of a stroke, if a pressure applied to the nozzle head 2 is removed, the first and the second coupling tubes 81 and 82 ascend by the action of the coil spring 24 relatively to the second piston 83. By this motion, as shown in FIG. 3, the convex portion 92 formed at the lower end of the second coupling tube 82 contacts the concave portion formed in the second piston 83. Consequently, the flow path leading to inside the first and the second coupling tubes 81 and 82 from inside the second cylinder 23 is closed again.

After that, the nozzle head 2, the first and the second coupling tubes 81 and 82 and the second piston 83 ascend all together by the action of the coil spring 24. At this time, because inside the second piston 23 is depressurized, the opening portion 41 is opened by the tapered portion of the valve body 89 separating from the inner tapered portion at the lower end of the second cylinder 23, and the fluid flows into the second cylinder 23 from the fluid storing portion 4 through the notch portion formed in the stopper. As shown in FIG. 3, if the second piston 83 moves to the upper limit of its elevating stroke, it stops to ascend.

By repeating the above-mentioned motions, discharging the fluid stored in the fluid storing portion 4 from the nozzle head 2 becomes possible.

The configurations of the first and the second piston 16 and 83, which are characteristic of the present invention, are described below.

Figure 4A:
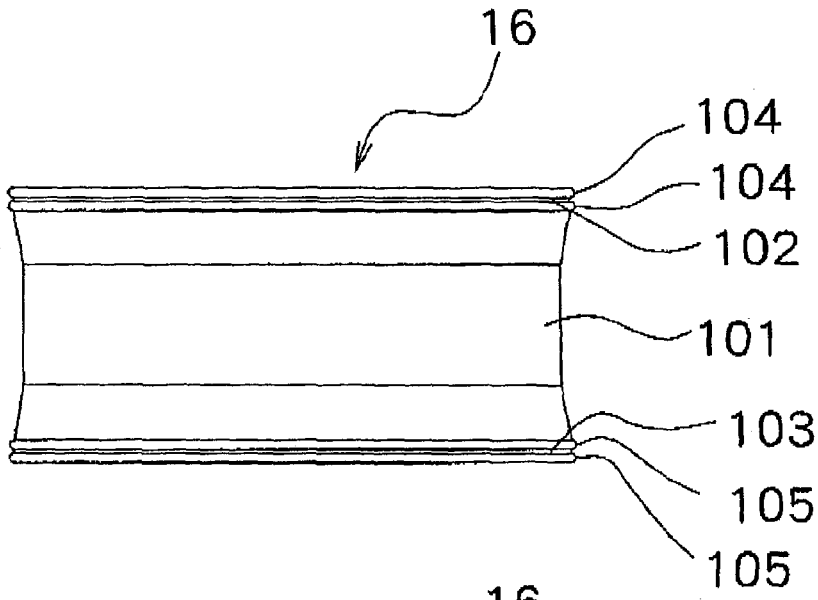
FIGS. 4(A) and 4(B) are a schematic diagram illustrating an enlarged view of the first piston 16.
Figure 4B:
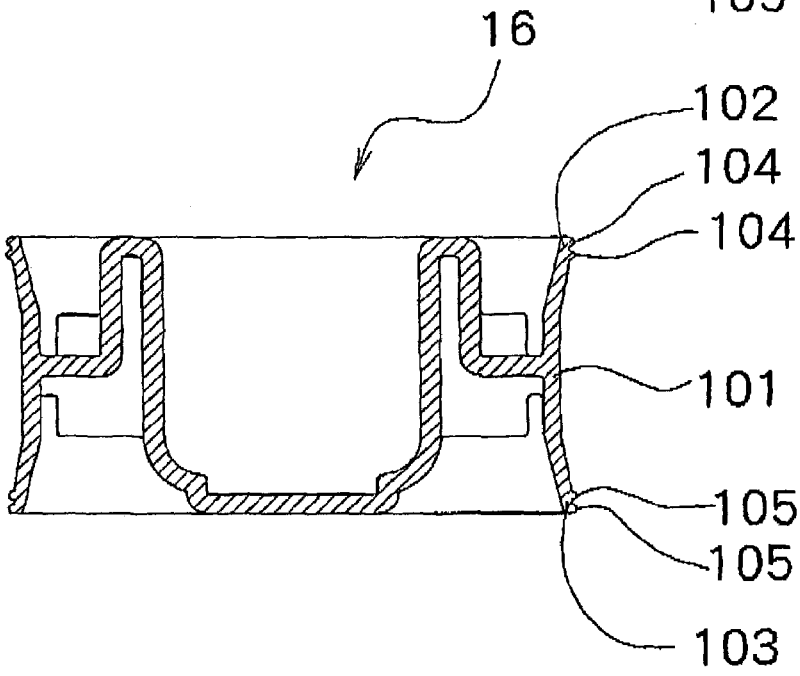
Figure 5:
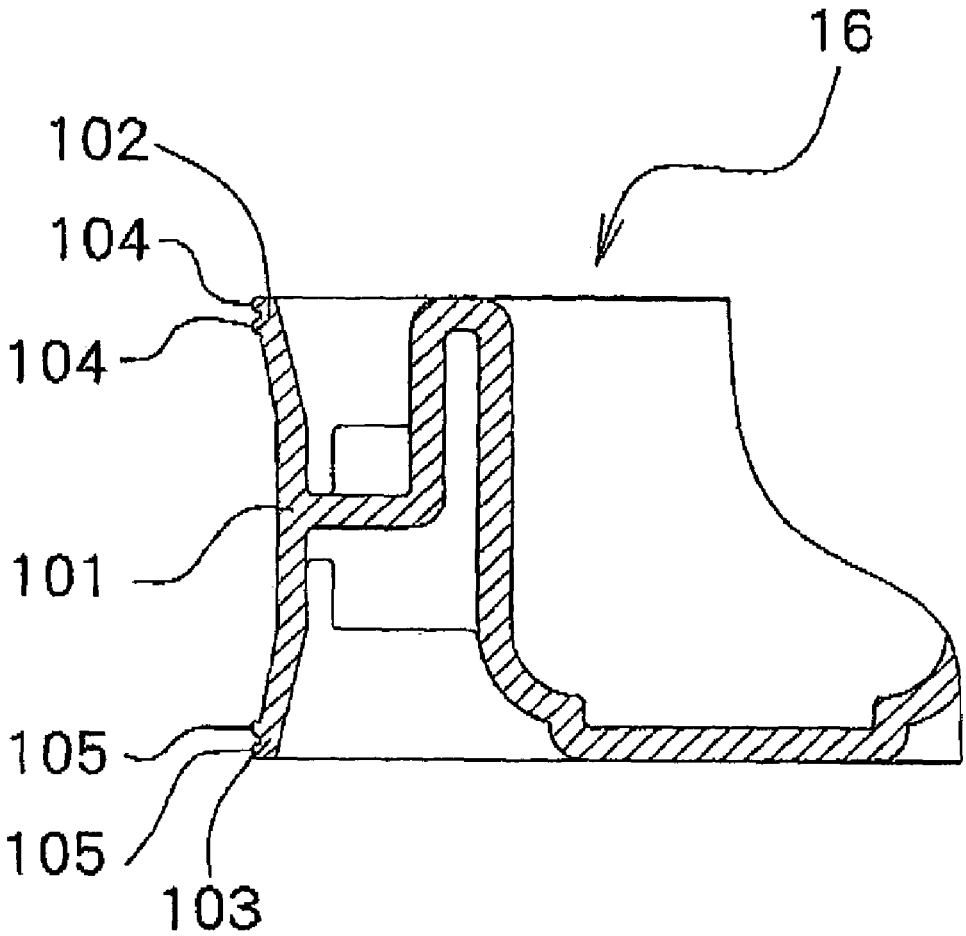
FIG. 5 shows the first piston 16 by further enlarging it.

The configuration of the first piston 16 is first described. FIGS. 4(A) and 4(B) show enlarged views of the above-mentioned first piston 16. FIG. 4(A) is a lateral view of the first piston 16. FIG. 4(B) is a cross-section of the first piston 16. FIG. 5 shows a cross-section of the first piston 16 by further enlarging it.

At the top of the first piston 16, a liquid portion 102 contacting the inner circumferential portion of the first cylinder 15 is formed the bottom of the first piston 16, a liquidthight portion 103 contacting the inner circumferential portion of the first cylinder 15 is formed. In other words, in the outer circumferential surface of the first piston 16, a pair of liquidtight portions 102 and 103 which contact the inner circumferential surfaces are arranged in positions apart only by a certain distance.

A portion contacting the inner circumferential surface of the fist cylinder 15 in the liquidtight portion 102 comprises pair of convex portions 104 and 104' arranged adjacently. A portion contacting the inner circumferential surface of the first cylinder 15 in the liquidtight portion 103 comprises a pair of convex portions 105 and 105' arranged adjacently. These convex portions 104*s* and 105*s* have a nearly round cross-sectional surface as shown in FIG. 5 after magnification.

In this first piston 16, by the action of a pair of liquidtight potions 102 and 103 arranged in positions apart only by a certain distance, the shaft core of the first piston and the shaft core of the first cylinder 15 can be brought in line at all the times regardless of the direction of a stress applied to the first piston, making it possible to move the first piston 16 smoothly inside the first cylinder 15.

Because the contact portions in a pair of liquidtight portions 102 and 103, which contact the inner circumferential surfaces of the first cylinder 15, comprises a pair of convex portions 104 and 104', liquidtight performance can be doubled while a contact area of the first piston 16 inside the first cylinder 15 is reduced, making it possible to move the first piston 16 inside the first cylinder 15 using a small force while accomplishing sufficient liquidtightness.

Figure 6A:
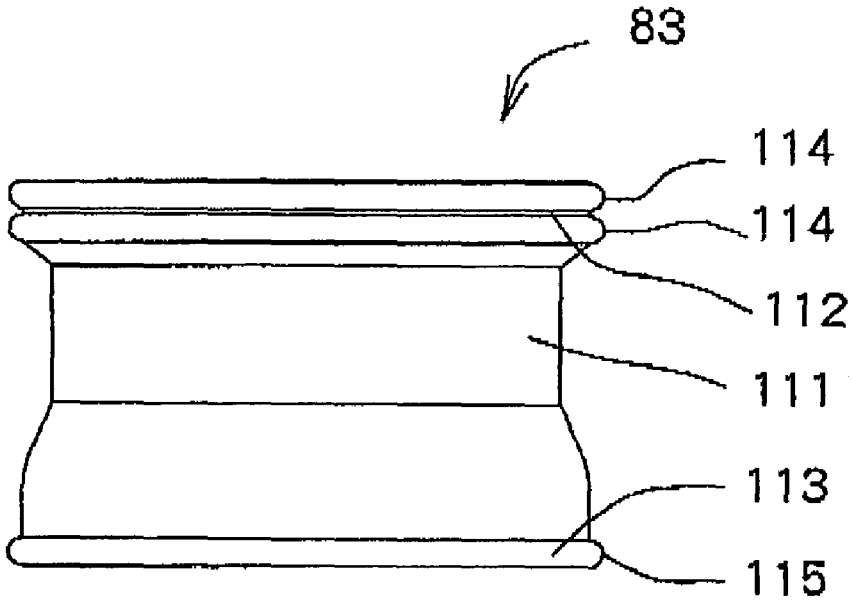
FIGS. 6(A) and 6(B) are a schematic diagram illustrating an enlarged view of the second piston 83.
Figure 6B:
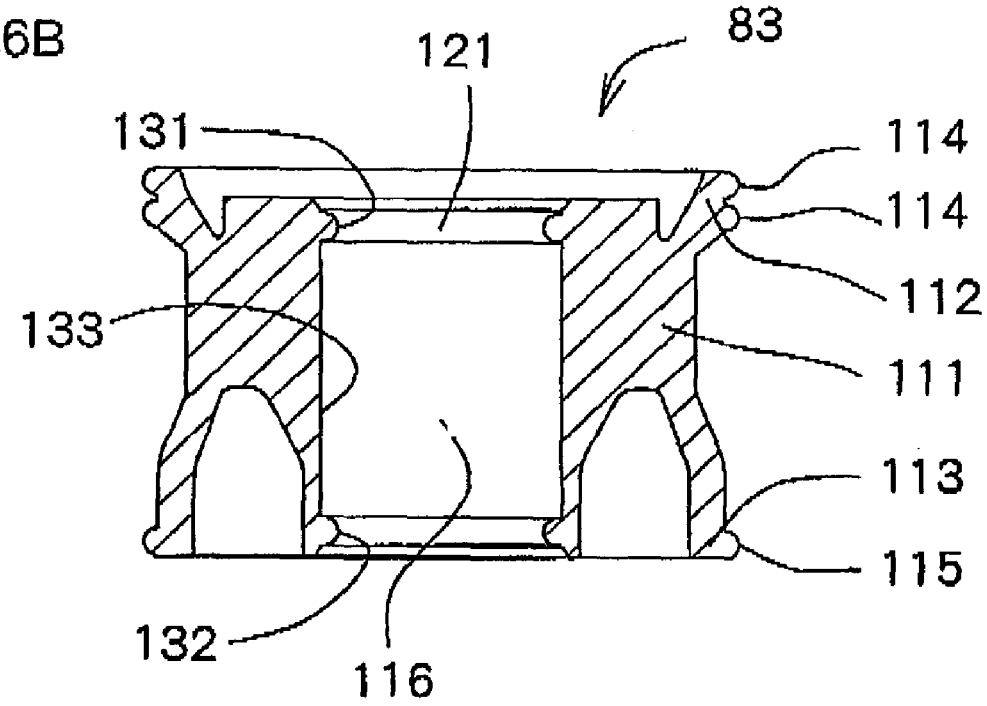

The configuration of the second piston 83 is described below. FIGS. 6(A) and 6(B) are an enlarged view of the above-mentioned second piston 83. FIG. 6(A) is a lateral view of the second piston 83. FIG. 6(B) shows a cross-section of the second piston 83.

At the top of this second piston 83, a liquidtight portion 112 which contacts the inner circumferential surface of the second cylinder 23, is formed. At the bottom of the second piston 83, a liquidtight portion 113, which contacts the inner circumferential surface of the second piston 23, is formed. In other words, in the outer circumferential surface of the second piston 83, a pair of liquidtight portions 112 and 113, which contact respective inner circumferential surfaces of the second piston 83, are arranged in positions apart only by a certain distance.

The contact portion in the liquidtight portion 112, which contacts the inner circumferential surface of the second cylinder 23, comprises a pair of convex portions 114 and 114' arranged adjacently; the contact portion in the liquidtight portion 113, which contacts the inner circumferential surface of the second cylinder 23, comprises a single convex portion 115. These convex portions 114*s* and 115 have a nearly round cross-sectional surface.

In the air holes of the second coupling tube 82 in the second piston 83, a convex portion 121 is formed to increase liquidtightness of the second piston 83 and the second coupling tube 82.

in this second piston 83, similarly to the first piston, by the action of a pair of the liquidtight portions 112 and 113 arranged in positions apart only by a certain distance, regardless of the direction of a stress applied to the second piston 83, the shaft core and the second piston and the shaft core of the second cylinder can be brought in line at all the times, making it possible to move the second piston 83 smoothly inside the second cylinder 23.

Because the contact portion in the other liquidtight portion 112, which contacts the inner circumferential surface of the second cylinder 23, comprises a pair of convex portions 114 and 114' arranged adjacently, liquidtightness performance can be doubled while a contact area of the second piston 83 and the second cylinder 23 is reduced, making it possible to move the second piston 83 inside the second cylinder 23 using a small force while accomplishing sufficient liquidtightness.

The other liquidtight portion 113 comprises a single convex portion 115, which is inferior in liquidtightness as compared with a pair of convex portions arranged adjacently. Nevertheless, the liquidtight function of the second cylinder 23 is secured by the other liquidtight portion 112.

In the above-mentioned embodiment, as the convex portions 104*s*, 105, 114 and 115, those having a nearly round section shape are used. A convex portion having a polygonal shape or having its edge pointed also can be adopted.

In the above-mentioned embodiment, the cases in which the present invention applies to fluid containers used as containers for cosmetics were described. The present invention, however, also can be applied to containers used for food and drinks, etc.

As explained above, the forgoing embodiments exhibit the following effects: By the action of a pair of the liquidtight portions arranged in positions apart only by a certain distance, the shaft core of the piston and the shaft core of the cylinder can be brought in line at all the times, making it possible to move the piston smoothly inside the cylinder.

Because the contact portion in at least one liquidtight portion, which contacts the inner circumferential surface of the cylinder, comprises a pair of convex portions arranged adjacently, liquidtight performance can be doubled while a contact area of the piston and the cylinder is reduced, making it possible to move the piston inside the cylinder using a small force while accomplishing sufficient liquidtightness.

Figure 7:
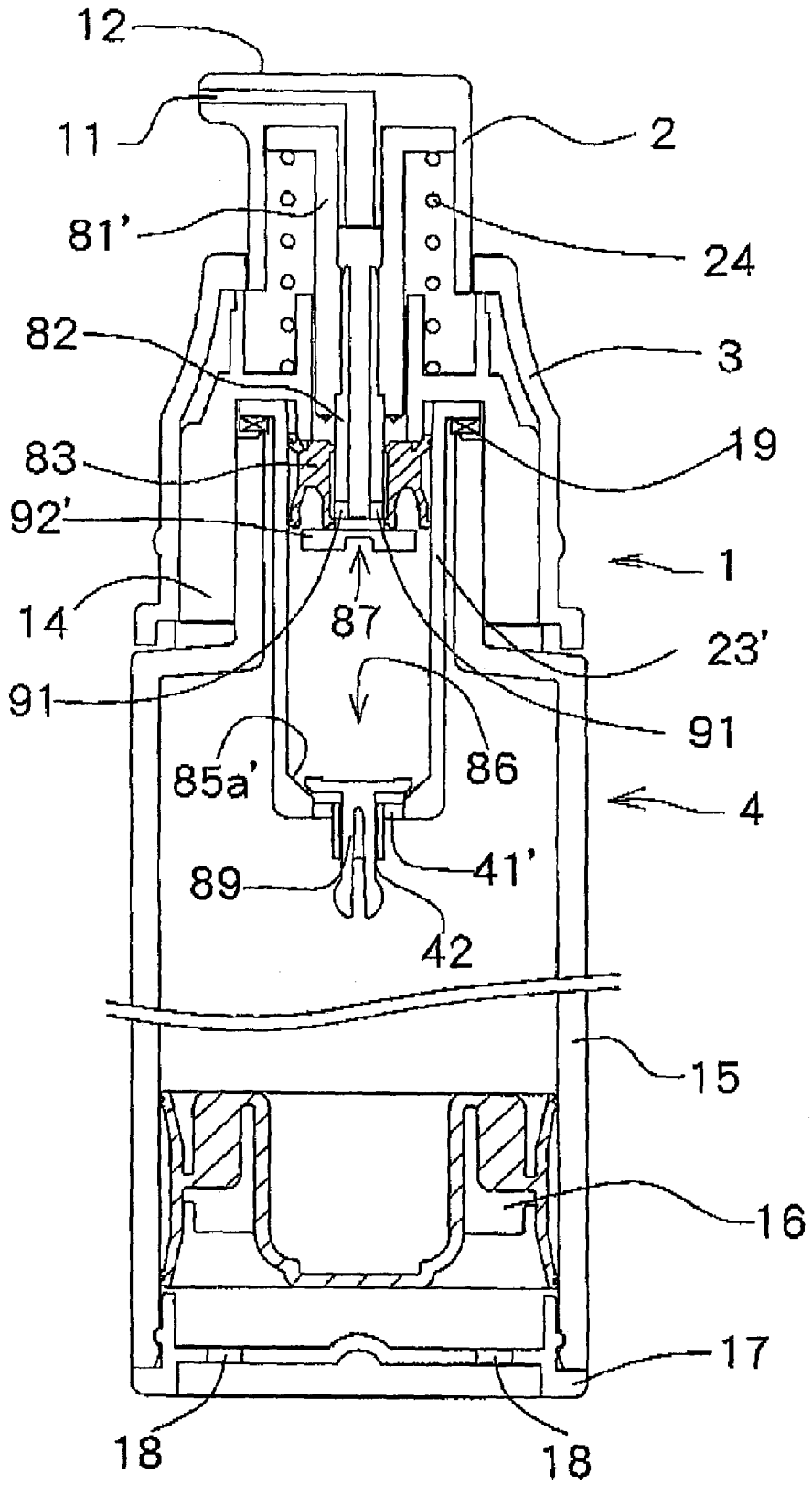
FIG. 7 is a schematic diagram illustrating a longitudinal section of a liquid container to which the valve mechanism 86 according to an embodiment of the present invention applies.
Figure 8:
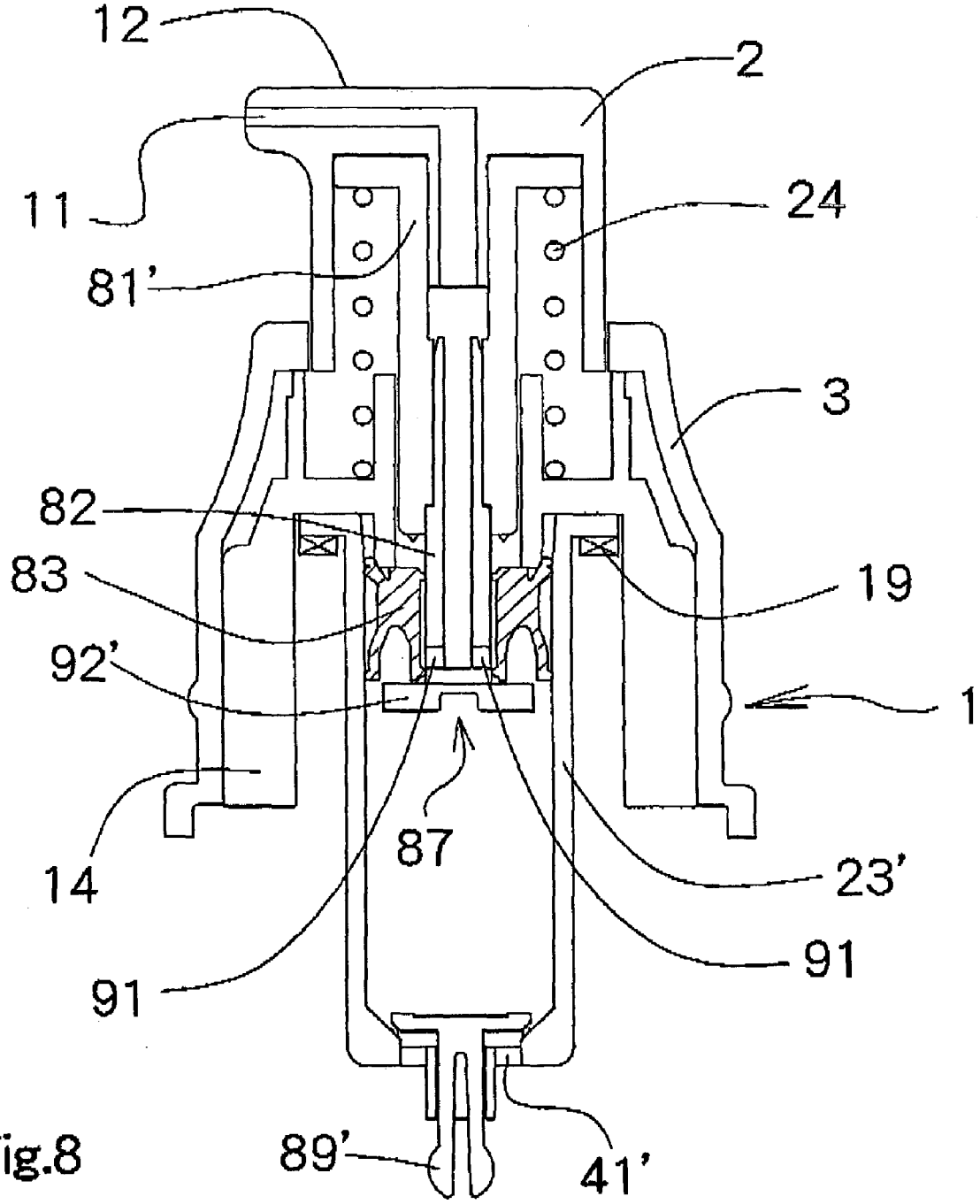
FIG. 8 is a schematic diagram illustrating an enlarged view of the relevant part of a liquid container to which the valve mechanism 86 according to an embodiment of the present invention applies.
Figure 9:
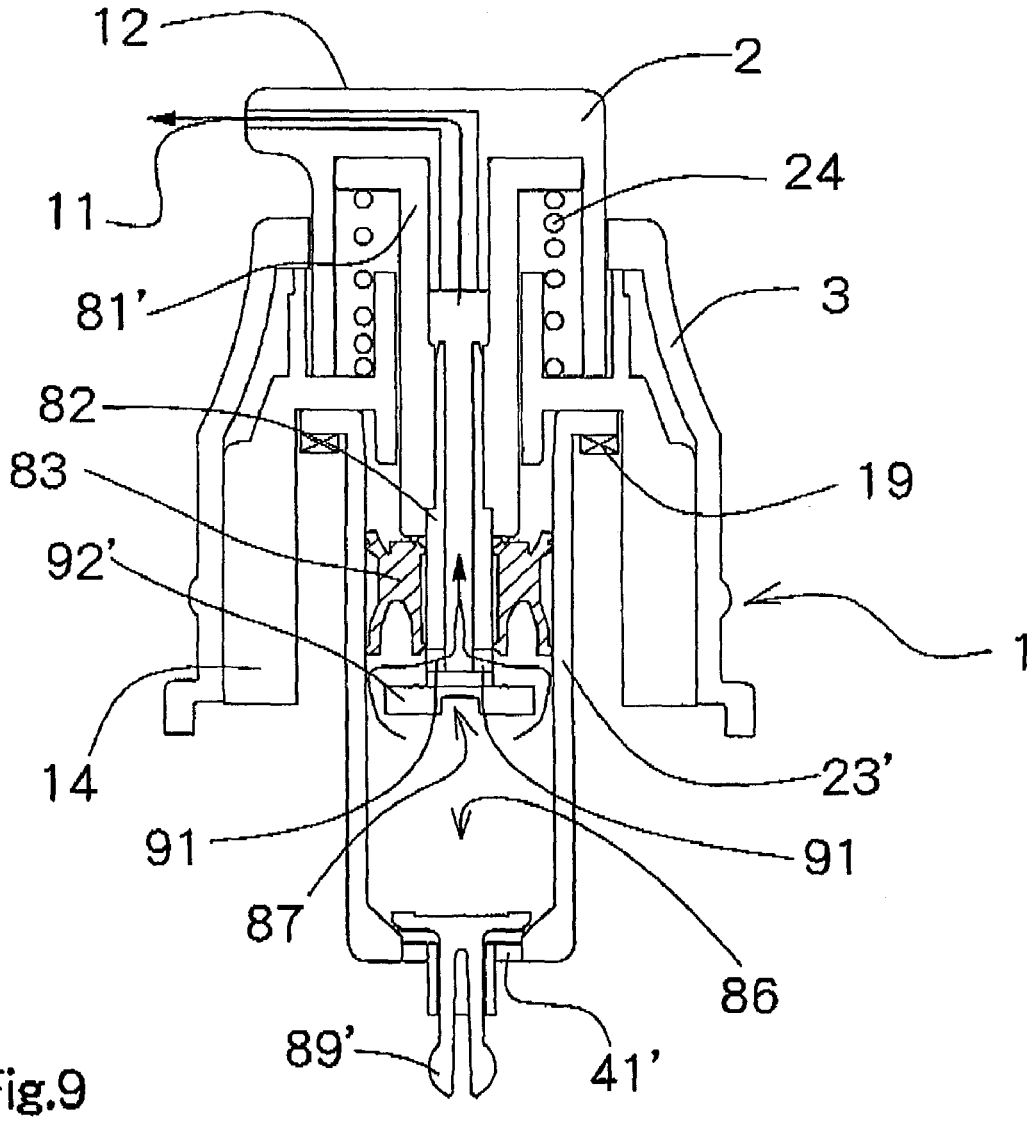
FIG. 9 is a schematic diagram illustrating an enlarged view of the relevant part of a liquid container to which the valve mechanism 86 according to an embodiment of the present invention applies.
Figure 10:
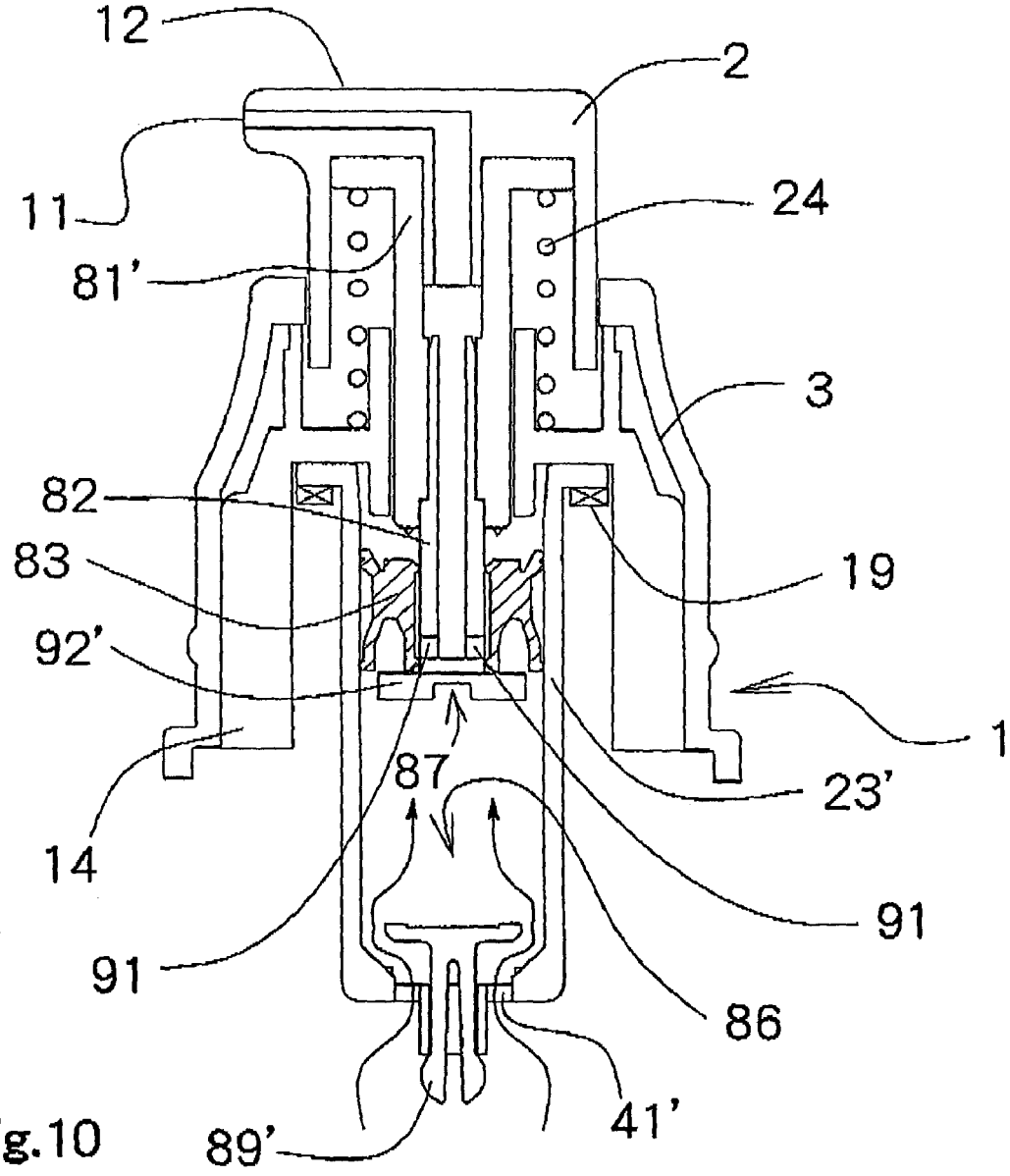
FIG. 10 is a schematic diagram illustrating an enlarged view of the relevant part of a liquid container to which the valve mechanism 86 according to an embodiment of the present invention applies.

The third embodiment of the present invention is described in detail by referring to figures. FIG. 7 shows a longitudinal section of a liquid container to which the valve mechanism 86 according to the first embodiment of the present invention applies. FIG. 8 to FIG. 10 show enlarged views of its relevant part.

Of these figures, FIG. 7 and FIG. 8 show positions in which no stress is given to a liquid discharge pump 1. FIG. 9 shows a position in which the first and the second coupling tubes 81' and 82 descend along with the second piston 83 with the pressing portion 12 at a nozzle head 2 being pressed. FIG. 10 shows a position in which the first and the second coupling tubes 81' and 82 ascend along with the second piston 83 with a pressure applied to the nozzle head 2 being released.

This fluid container is used as a container for beauty products for storing gels such as hair gels and cleansing gels or creams such as nourishing creams and cold creams or liquids such as skin toners used in the cosmetic field. This liquid container also can be used as a container for medicines, solvents or foods, etc. In this specification, high-viscosity liquids, semifluids, gels that sol solidifies to a jelly, and creams, and regular liquids, are all referred to as fluids.

This liquid container comprises a liquid discharge pump 1, a nozzel head 2, an outer lid 3 and a liquid storing portion 4 for storing a liquid inside it.

The nozzle head 2 has a discharge portion 11 for discharging a liquid and a pressing portion 12 which is pressed when the liquid is discharged. Additionally, the outer lid 3 is engaged with a screw portion formed at the top of the liquid storing portion 4 via a screw material 14.

The liquid storing portion 4 has the first cylinder 15 which is cylindrical, the first piston 16 which moves inside the first cylinder 15 is upward and downward directions, and an outer lid 17 in which a number of air holes 18 are provided. The first cylinder 15 at the liquid storing portion 4 and the liquid discharge pump 1 are connected in a liquidtight position via packing 19.

In this liquid container, by pressing the pressing portion 12 at the nozzle head 2, reciprocating motions are generated by the action of the liquid discharge pump 1. By these motions, a liquid stored in the liquid storing portion 4 is discharged from the discharge portion 11. As an amount of the liquid inside the liquid storing portion 4 reduces, the first piston 16 moves in side the first cylinder 15 toward the nozzle head 2.

In this specification, upward and downward directions in FIGS. 7 to 10 are defined as upward and downward directions in the fluid container. In other words, in the fluid container according to this embodiment, the side of the nozzle head 2 shown in FIG. 7 is defined as the upward direction, and the side of the first piston 16 is defined as the downward direction.

The configuration of the fluid discharge pump 1 is described below.

This fluid discharge pump 1 possesses: The second cylinder 23'; the second piston 83 which can reciprocate inside the second cylinder 23'; the first and the second hollow coupling tubes 81' and 82 coupled and fixed with each other to form a coupling tube for sending down the second piston 83 by transmitting a pressure given to the nozzle head 2 to the second piston 83, by coupling the nozzle head 2 and the second piston 83; a contact portion 92' provided at the lower end of the second coupling tube 82; a coil spring 24 set up at the outer perimeter of the first and the second coupling tubes 81' and 82 for giving momentum to the second piston 83 in the direction of raising it; the valve mechanism 86 according to the present invention for flowing a fluid stored in the fluid storing portion 4 into the second cylinder 23' as the second piston 83 ascends; a closed mechanism 87 for letting the fluid which flowed into the second cylinder 23' out to the nozzle head 2 through inside the first and the second coupling tubes 81' and 82 as the second piston 83 descends.

The contact portion 92' at the above-mentioned closed mechanism 87 is used to open a flow path communicating with inside the first and the second coupling tubes 81' and 82 and inside the second cylinder 23' by separating from the second piston 83 when the nozzle head 2 is pressed, and to close the flow path communicating with inside the first and the second coupling tubes 81' and 82 and inside the second cylinder 23' by contacting the second piston 83 when a pressure applied to the nozzle head 2 is removed.

Down below the cylindrical portion of the second coupling tube 82, an opening portion 91 is shown in FIG. 9, in a position in which the lower end of the second piston 83 and the contact portion 92' provided at the lower end of the second coupling tube 82 are separated, a flow path leading to inside the first and the second coupling tubes 81' and 82 from inside the second cylinder 23' through the opening portion 91 is formed. As shown FIG. 8 and FIG. 10, in a position in which the lower end of the second piston 83 and the contact portion 92' provided at the lower end of the second coupling tube 82 are contacted, the flow path leading to inside the first and the second coupling tubes 81' and 82 from inside the second cylinder 23' is closed.

The valve mechanism 86 according to the present invention is used to close an opening portion 41' communicating with the liquid storing portion 4 formed in the vicinity of the lower end of the second cylinder 23' and the second cylinder 23' when inside the second cylinder 23' is pressurized, and to open the opening portion 41' when inside the second cylinder 23' is depressurized.

Figure 11A:
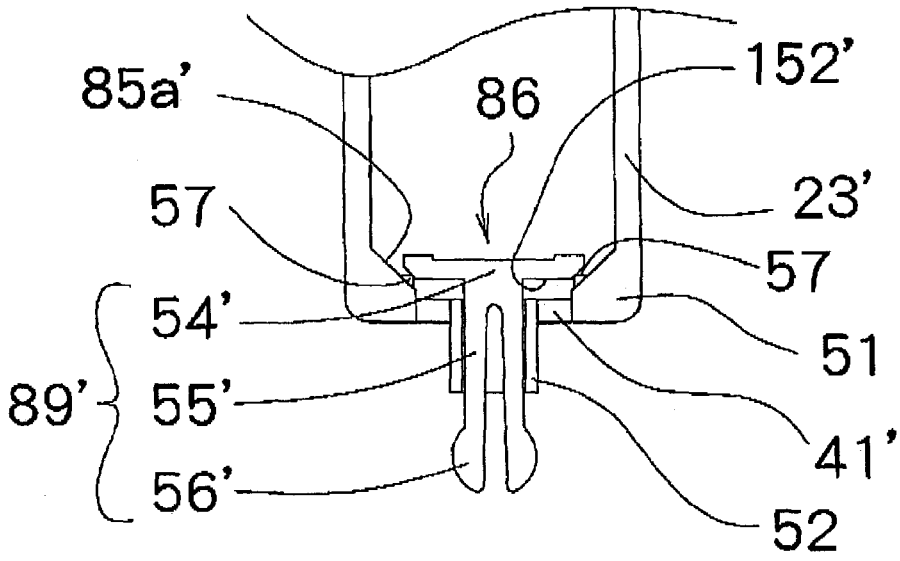
FIGS. 11(A) and 11(B) are a schematic diagram illustrating an enlarged illustration of the valve mechanism 86.
Figure 11B:
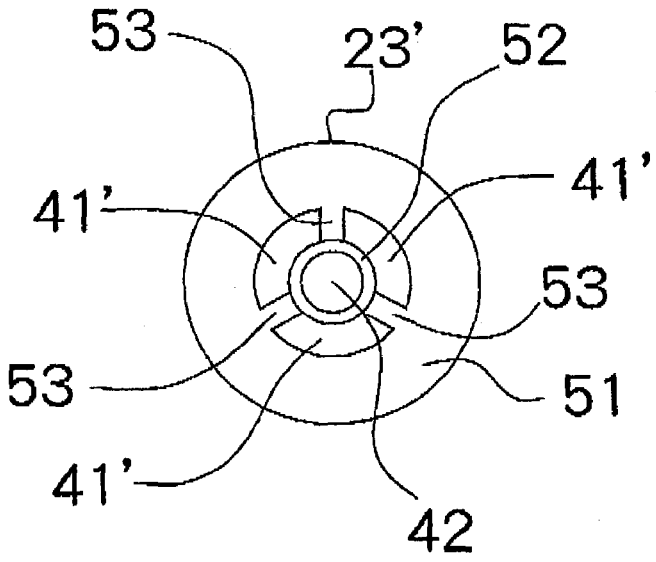

FIGS. 11(A) and 11(B) are an enlarged illustration of the valve mechanism 86. FIG. 11(A) shows a lateral view of the valve mechanism 86. FIG. 11(B) shows the bottom of the second cylinder 23'.

The valve mechanism 86 possesses the above-mentioned second cylinder 23' which is a cylindrical main unit with a bottom and has the opening 41' at its bottom 51, a cylindrical portion 52 having an external form smaller than the internal diameter of the opening portion 41 ' at the second cylinder 23', and a valve seat having a coupled portion 53, which couples the second cylinder 23' and the cylindrical portion 52 for fixing the cylindrical portion 52 within the opening portion 41'.

At a portion at the second cylinder 23', which contacts a valve body 89' described later of the second cylinder 23', a protruding portion 57 is formed. Consequently, even when the manufacturing accuracy of the second cylinder 23' or the valve body 89' described later has deteriorated the valve body 89' and the protruding portion 57 can be contacted reliably; as compared with cases in which a surface and a surface are contacted, maintaining higher liquidtightness becomes possible.

Additionally, this valve mechanism possesses the valve body 89' having a valve portion 54', which closes the opening portion 41' by contacting the above-mentioned protruding portion 57 at the bottom 51 of the second cylinder 23' and opens the opening portion 41' by separating from the protruding portion 57 at the bottom 51, a guide portion 55', which has an external form smaller than the internal diameter of the cylindrical portion 52 and a length longer than that of the cylindrical portion 52, and which, by being inserted inside the cylindrical portion 52, guides a movement between a position at the valve portion 57 which contacts the protruding portion 57 at the bottom 51 and a position which separates from the protruding portion 57, and a regulating portion 56' for preventing the guide portion 55' from coming off from the cylindrical body 52.

The above-mentioned valve seat and valve body 89' are produced by molding polypropylene or polyethylene, or resin such as silicone rubber.

For the valve body 89', a dividing groove is provided from its guide portion 55' to its regulating portion 56'. By the action of the dividing groove, it becomes possible to press the regulating portion 56' of the valve body 89' into the cylindrical portion 52, and after being pressed into, coming off of the guide portion 55' from the cylindrical portion 52 can be prevented.

Discharge motions of the fluid discharge container possessing the above-mentioned fluid discharge pump 1 are designed below.

In an initial position, as shown in FIG. 7 and FIG. 8, momentum is given to the first and the second coupling tubes 81' and 82 coupled with each other in an upward direction by the action of the coil spring 24, and the contact portion 92' provided at the lower end of the second coupling tube 82 contacts the lower end of the second piston 83. Consequently, a flow path leading to inside the first and the second coupling tubes 81' and 82 from inside the second cylinder 23' is closed. Additionally, by the empty weight of the valve body 89', as shown in FIGS. 11(A) and 11(B), the valve portion 54' of the valve body 89' contacts the protruding portion 57 at the bottom 51 of the second cylinder 23', closing the opening portion 41'.

In this position, when the pressing portion 12 at the nozzle head 2 is pressed, as shown in FIG. 9, the first and the second coupling tubes 81' and 82 first descend relatively to the second piston 83. By this motion, the contact portion 92' formed at the lower edge of the second coupling tube 82 separates from the lower end of the second piston 83. Consequently, the flow path leading to inside the first and the second coupling tubes 81' and 82 from inside the second cylinder 23' via the opening 91 is formed.

If the pressing portion 12 at the nozzle head 2 is pressed further, the lower end of the second coupling tube 81' contacts the top of the second piston 83, and the second piston 83 and the first and the second coupling tubes 81' and 82 descend all together. At this time, inside the second cylinder 23' is pressurized, and as shown in FIGS. 11(A) and 11(B), the opening 41' is closed with the valve portion 54' of the valve body 89' contacting the protruding portion 57 at the lower end 51 of the second cylinder 23'. Consequently, the pressurized fluid inside the second cylinder 23' flows out to the discharge portion 11 at the nozzle head 2 through the opening portion 91, and the first and the second hollow coupling tubes 81' and 82, and is discharged from the discharge portion 11.

After the second piston 83 descends to the lower limit of a stroke, if a pressure applied to the nozzle head 2 is removed, the first and the second coupling tubes 81' and 82 ascend relatively to the second piston 83 by the action of the coil spring 24. By this motion, as shown in FIG. 10, the contact portion 92' provided at the lower end of the second coupling tube 82 contacts the lower end of the second piston 83. Consequently, the flow path leading to inside the first and the second coupling tubes 81' and 82 from inside the second cylinder 23' is closed again.

After that, the nozzle head 2, the first and the second coupling tubes 81' and 82 and the second piston 83 ascend all together by the action of the coil spring 24. At this time, because inside the second piston 23' is depressurized, the opening portion 41' is opened by the valve portion 54' of the valve body 89' separating from the protruding portion 57 at the bottom 51 of the second cylinder 23', and the fluid flows into the second cylinder 23' from the fluid storing portion 4. If the second piston 83 moves to the upper limit of its elevating stroke, it stops to ascend.

By repeating the above-mentioned motions, discharging the fluid stored in the fluid storing portion 4 from the nozzle head 2 becomes possible.

In these liquid containers, it is preferred to alter a size of a passage portion through which a liquid passes according to a coefficient of viscosity of a liquid passing through it. In the above-mentioned valve mechanism, by altering a length of the guide portion 55' at the valve body 89', it becomes possible to set a size of the liquid passage portion, i.e. a size of an area between the valve portion 54' of the valve body and the bottom 51 of the second cylinder, at a discretional value.

According to the forgoing, the use of molded resins is possible and costs can be reduced. Additionally, a size of the liquid passage portion can be easily altered according to a coefficient of viscosity of a liquid used. Further, even when high accuracy of a valve seat and a valve body has deteriorated, the valve seat and the valve body can be contacted reliably by the action or the protruding portion.

Figure 12:
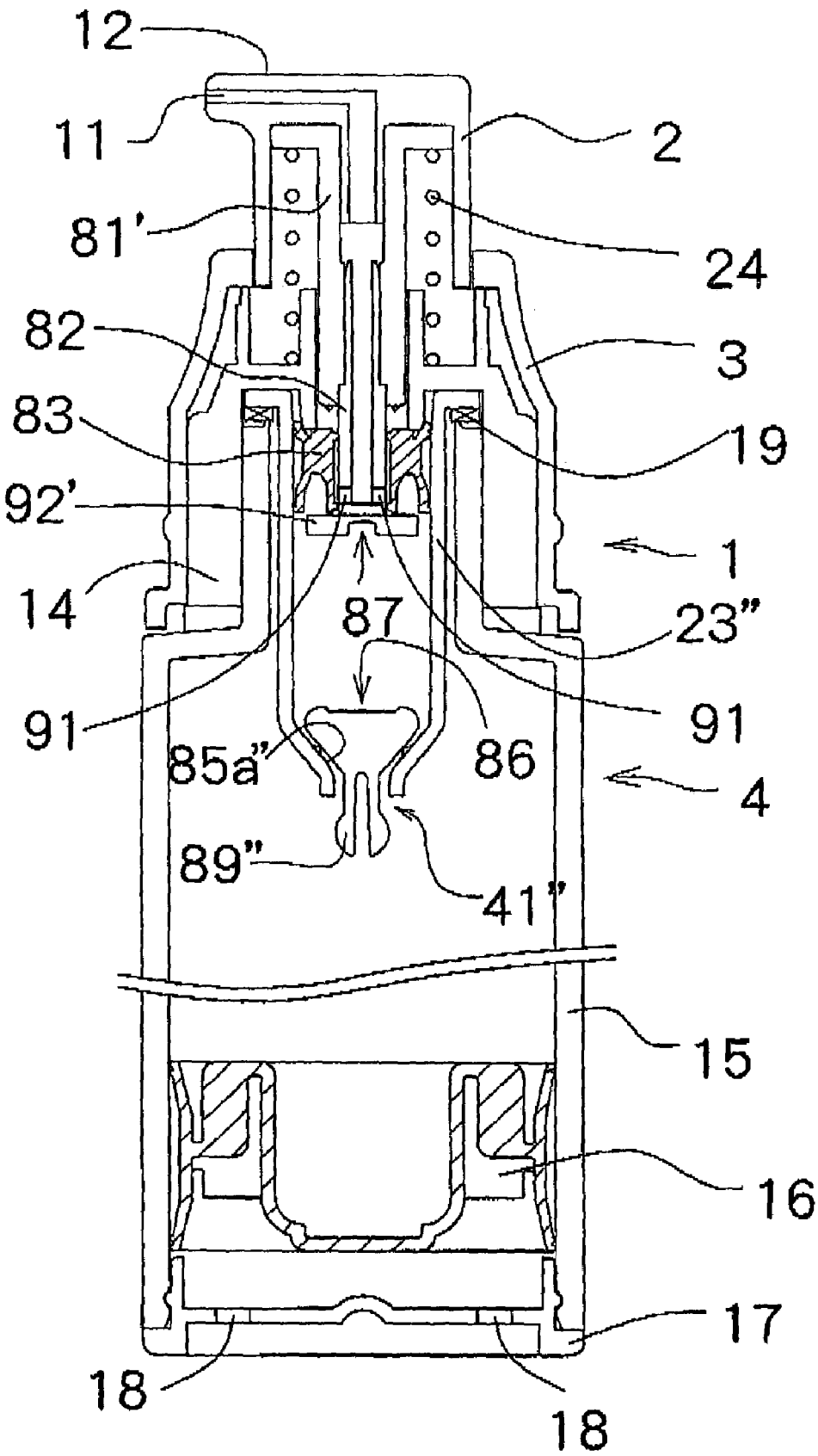
FIG. 12 is a schematic diagram illustrating a longitudinal sectional view of a liquid container to which the valve mechanism 86 according to an embodiment of the present invention applies.
Figure 13:
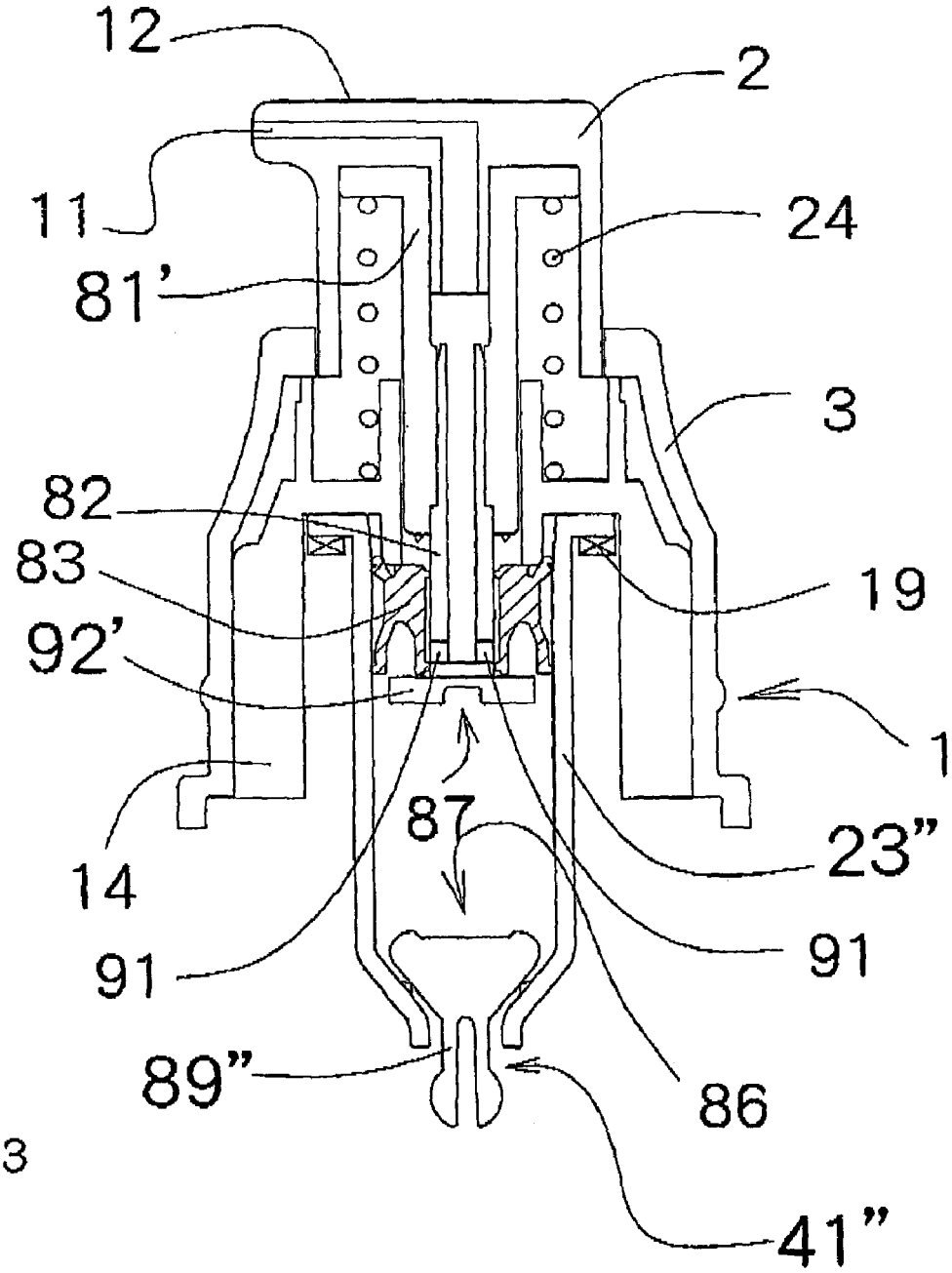
FIG. 13 is a schematic diagram illustrating an enlarged view of the relevant part of the liquid container to which the valve mechanism 86 according to an embodiment of the present invention applies.
Figure 15:
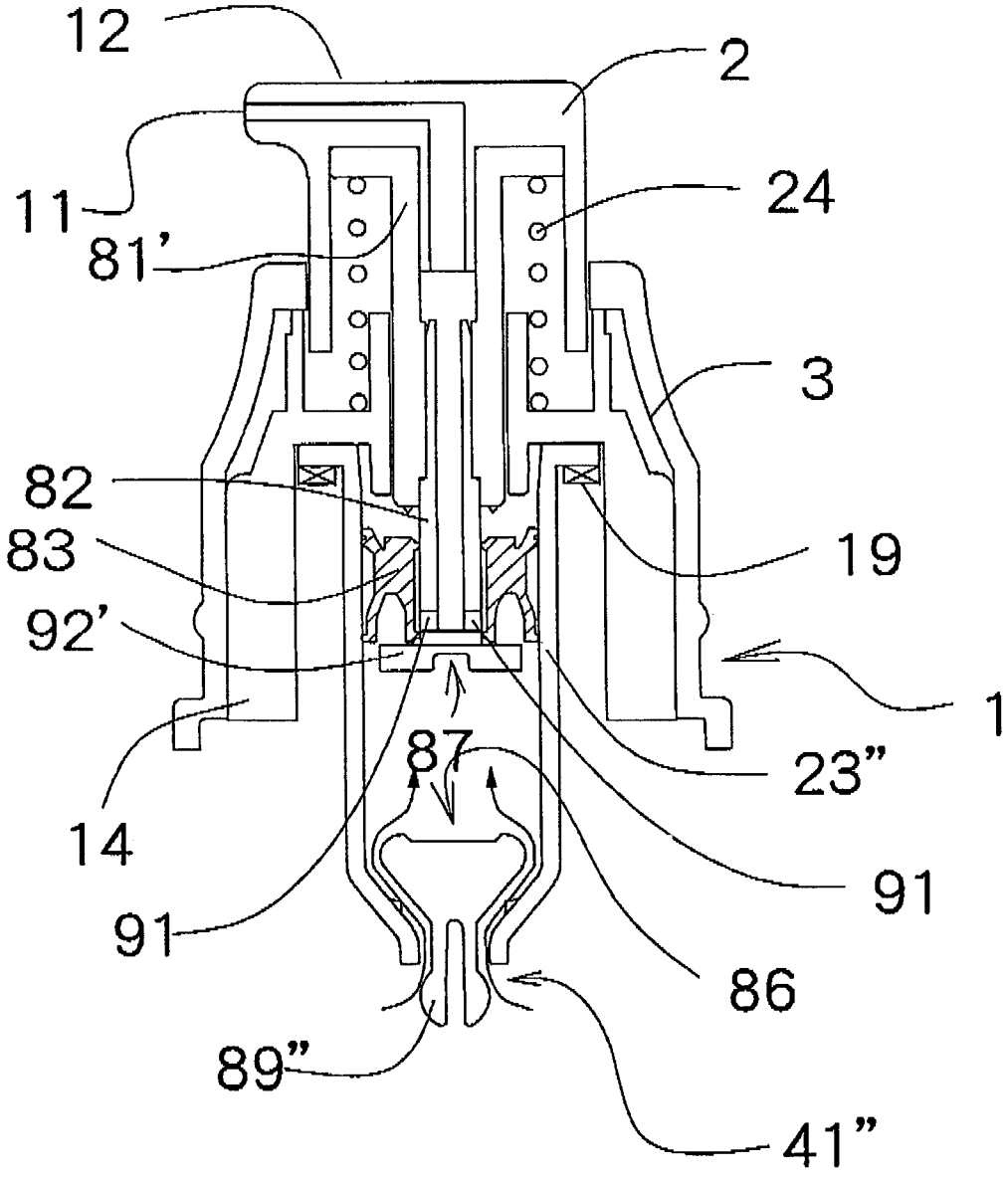
FIG. 15 is a schematic diagram illustrating an enlarged view of the relevant part of the liquid container to which the valve mechanism 86 according to an embodiment of the present invention applies.

The fourth embodiment is described in detail by referring to figures. FIG. 12 longitudinal section of a liquid container to which the valve mechanisms 86 and 87 according to the present invention applies. FIG. 13 and FIG. 15 enlarged views of the relevant part of the valve mechanisms.

Figure 14:
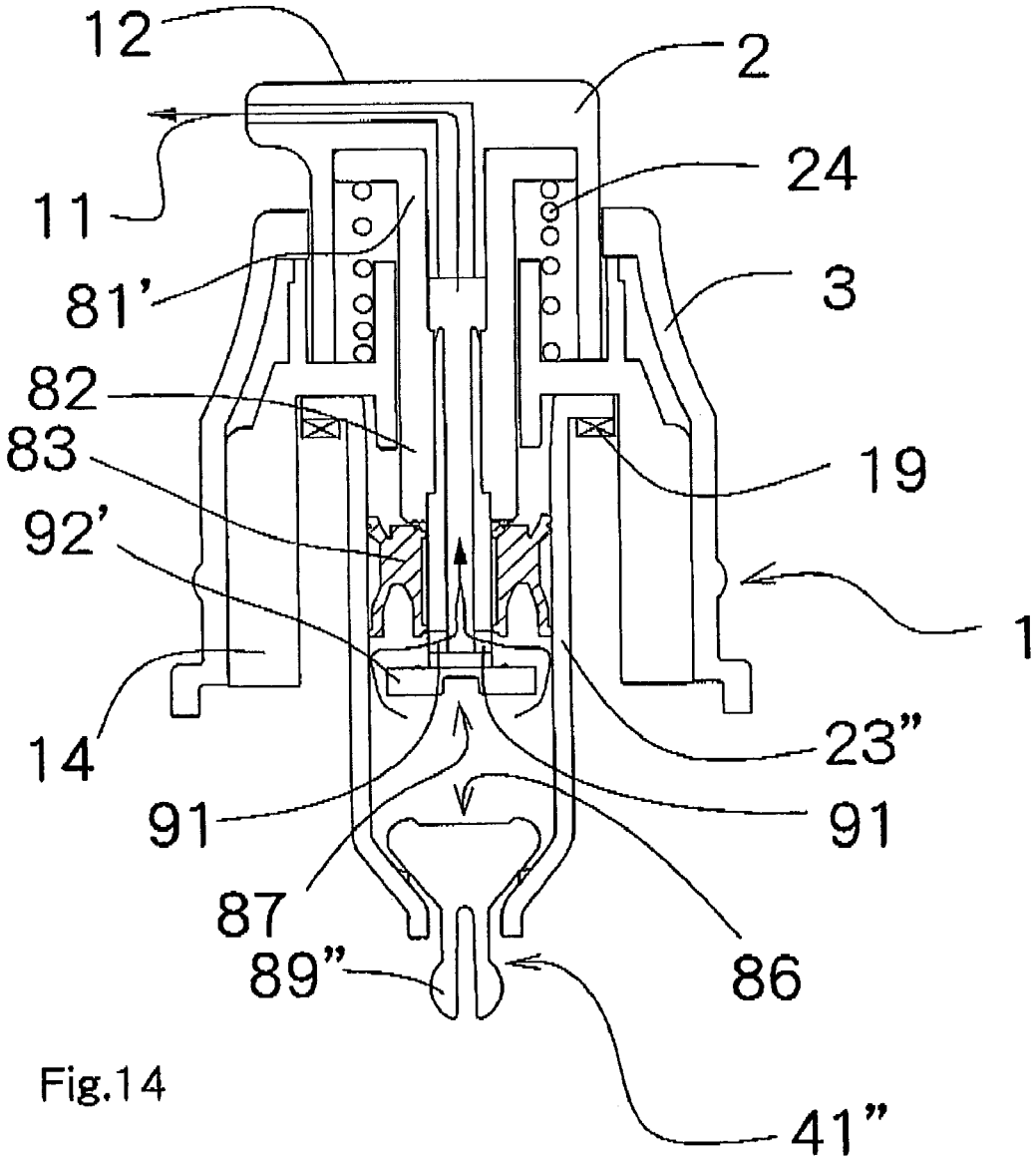
FIG. 14 is a schematic diagram illustrating an enlarged view of the relevant part of the liquid container to which the valve mechanism 86 according to an embodiment of the present invention applies.

Of these figures, FIG. 12 and FIG. 2 respectively show a position in which no stress is applied to a liquid discharge pump. FIG. 14 shows a position in which with a pressing portion 12 in a nozzle head 2 being pressed, the first and the second coupling tubes 81' and 82 are in the process of descending along with the second piston 83. FIG. 15 shows a position in which with the nozzle head 2 being opened, the first and the second coupling tubes 81' and 82 are in the process of ascending along with the second piston 83.

This liquid container is used as a container for beauty products for storing gels such as hair gels and cleansing gels or creams such as nourishing creams and cold creams or liquids such as skin toners used in the cosmetic field. This liquid container also can be used as a container for medicines, solvents or foods, etc. In this specification, high-viscosity liquids, semifluids, gels that sol solidifies to a jelly, and creams, and regular liquids, are all referred to as fluids.

This liquid container comprises a liquid discharge pump 1, a nozzel head 2, an outer lid 3 and a liquid storing portion 4 for storing a liquid inside it.

The nozzle head 2 has a discharge portion 11 for discharging a liquid and a pressing portion 12 to be pressed when the liquid is discharged. The outer lid 3 is engaged with a screw portion formed at the top of the liquid storing portion 3 via a screw material 14.

The liquid storing portion 4 has the first cylinder 15 which is cylindrical, the first piston 16 which moves in upward and downward directions inside the first cylinder 15, and an out lid 17 in which a number of air holes 18 are made. The first cylinder 15 in the liquid storing portion 4 and the liquid discharge pump 1 are connected in a liquidtight position via packing 19.

In this liquidtight container, by the action of the liquid discharge pump 1, which generates reciprocating motions by pressing the pressing portion 12 at the nozzle head 2, a liquid stored inside the liquid storing portion 4 is discharged from the discharge portion 11 at the nozzle head. As an amount of the liquid inside the liquid storing portion 4 reduces, the first piston 16 moves inside the first cylinder 15 toward the nozzle head 2.

In this specification, the upward and the downward directions described in FIG. 12 to FIG. 15 are prescribed as the upward and downward directions in the liquid container. In other words, in the liquid container according to this embodiment, the side of the nozzle head 2 shown in FIG. 12 is defined as the upward direction, and the side of the first piston 16 is defined as the downward direction.

The configuration of the liquid discharge pump 1 is described below.

The liquid discharge pump 1 possesses: the second cylinder 23"; the second piston 83 which can reciprocate inside the second cylinder 23"; the first and the second hollow coupling tubes 81' and 82 coupled and fixed with each other to form a coupling tube for sending down the second piston 83 by transmitting a pressure applied at the nozzle head 2 to the second piston 83, by coupling the nozzle head 2 and the second piston 83; a contact portion 92' provided at a lower end of the second coupling tube 82; a coil spring 24 arranged at an outer circumferential portion of the first and the second coupling tubes 81' and 82 for giving momentum to the second piston 83 toward its ascending direction; a valve mechanism 86 according to the present invention for bringing a liquid stored in the liquid storing portion 4 into the second cylinder 23" as the second piston 83 ascends.

The above-mentioned second piston 83 and the contact portion 92' comprise the valve mechanism 87 according to the present invention for letting the liquid which flowed into the second cylinder 23" out to the nozzle head 2 via inside the first and the second coupling tubes 81' and 82 as the second piston 83 descends.

In other words, when the nozzle head 2 is pressed, the contact portion 92' in the above-mentioned valve mechanism 87 separates from the second piston 83, opening a flow path communicating with inside the first and the second coupling tubes 81' and 82 and inside the second cylinder 23"; when a pressure applied to the nozzle head 2 is released, the contact portion 92' contacts the second piston 83, closing the flow path communicating with inside the first and the second coupling tubes 81' and 82 and inside the second cylinder 23". The contact portion 92' in the valve mechanism 87 corresponds to the valve seat according to the present invention; the second piston 83 in the valve mechanism 87 corresponds to the valve body according to the present invention.

Figure 16:
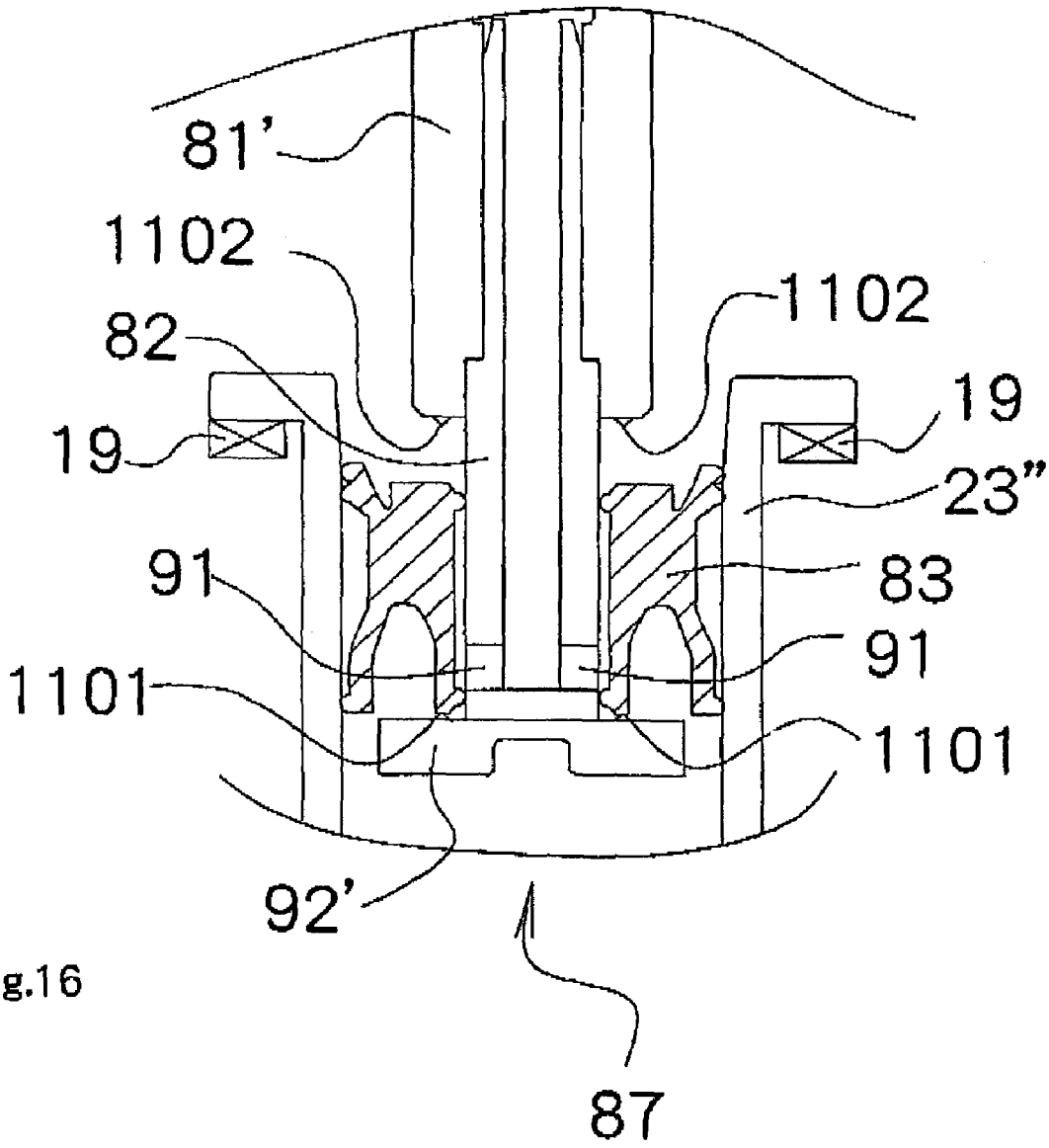
FIG. 16 is a schematic diagram illustrating an enlarged sectional view of the vicinity of the valve mechanism 87.
Figure 17:
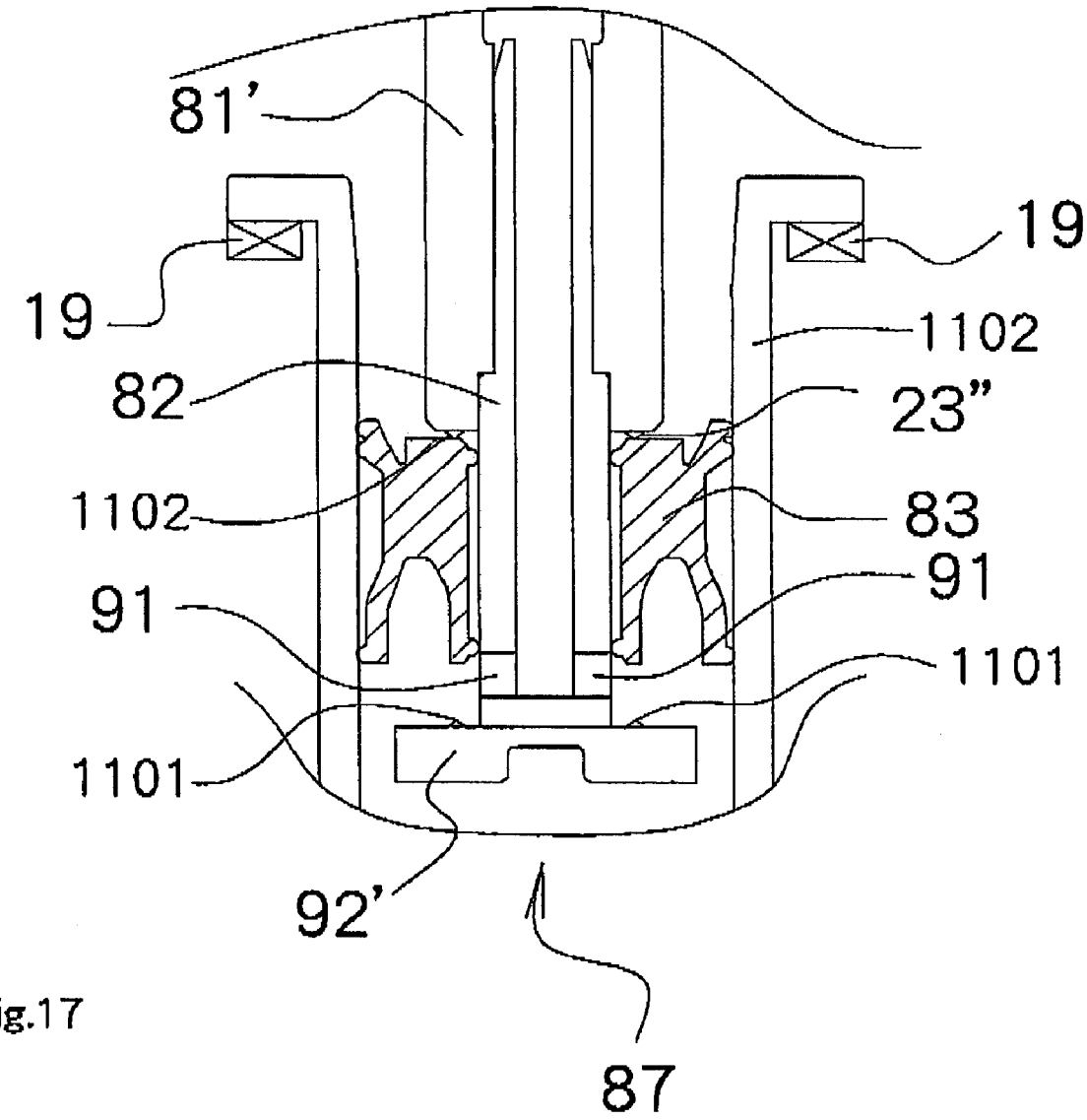
FIG. 17 is a schematic diagram illustrating an enlarged sectional view of the vicinity of the valve mechanism 87.

FIG. 16 and FIG. 17 are expanded sectional views showing in the vicinity of the valve mechanism 87.

As these figures show, at a portion at the contact portion 92', which contacts the second piston 83, a circular protruding portion 1101 is formed. Consequently, the contact portion 92' and the second piston 83 contact via this protruding portion 1101. Additionally, at a portion in the first coupling tube 81', which contacts the second piston 83, a circular protruding portion 1102 is also formed to increase liquidtightness in the valve mechanism 87.

Down below the cylindrical portion of the second coupling tube 82, an opening 91 is made. As shown in FIG. 14 and FIG. 17, in a position in which the lower end of the second piston 83 and the contact portion provided in the lower end of the second coupling tube 82 are separated, a flow path leading to inside the first and the second coupling tubes 81' and 82 from inside the second cylinder 23" via the opening 91 is formed.

As shown in FIG. 13, and FIG. 15 and FIG.16, in a position in which the lower end of the second piston 83 and the contact portion 92' provided at the lower end of the second coupling tube 82 contact via the protruding portion 1101, the flow path leading to inside the first and the second coupling tubes 81' and 82 from inside the second cylinder 23" is closed.

At this time, because the lower end of the second piston 83 and the contact portion 92' provided at the lower end of the second coupling tube 82 contact not by the surfaces but by the circular linear portion at the edge of the protruding portion 1101 via the protruding portion 1101, high liquidtightness can be accomplished even when manufacturing accuracy of the second piston 83 and the contact portion 92' has deteriorated.

The above-mentioned valve mechanism 86 is used for closing the opening portion 41" which communicating with the liquid storing portion 4 formed in the vicinity of the lower end of the second cylinder 23" and the second cylinder 23" when inside the second cylinder 23" is pressurized and for opening the opening portion 41" when inside the second cylinder 23" is depressurized.

Figure 18:
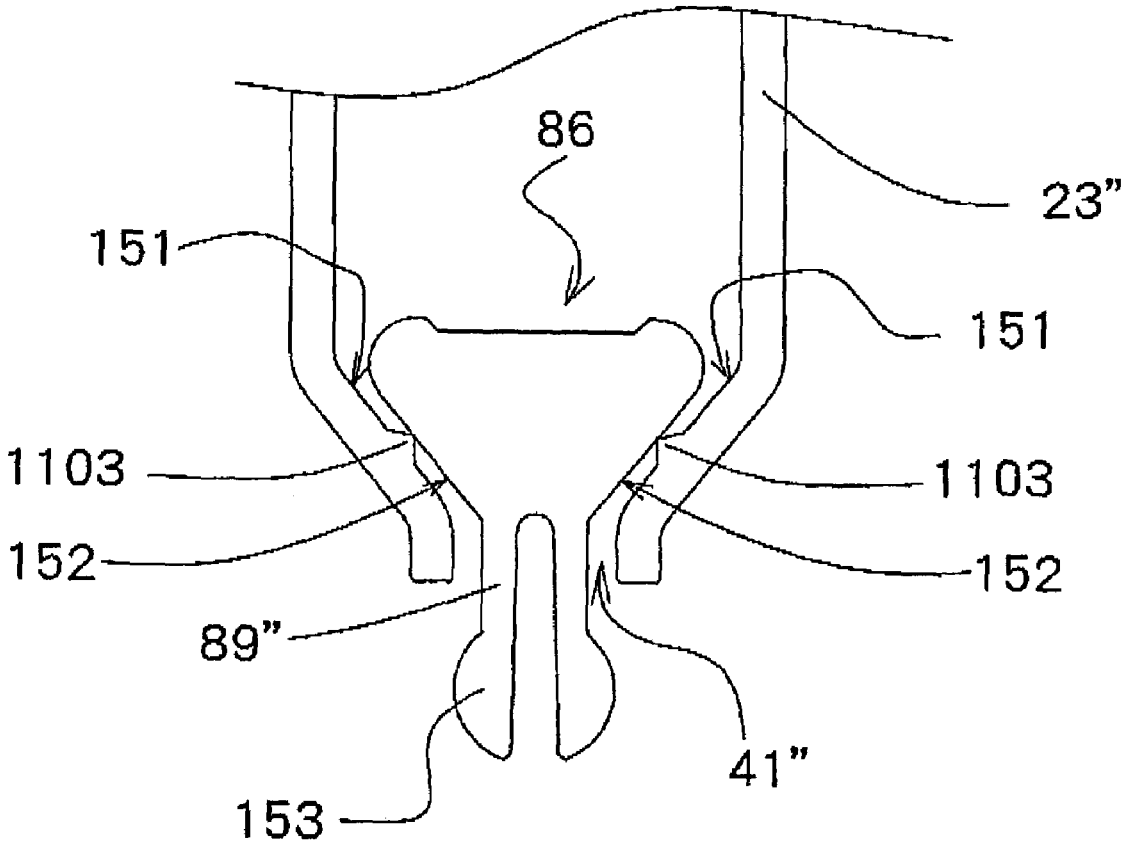
FIG. 18 is a schematic diagram illustrating an enlarged illustration of the valve mechanism 86.

FIG. 18 shows an enlarged view of the valve mechanism 86.

The valve mechanism 86 possesses a tapered portion 151 formed at the lower end of the second cylinder 23" which functions as a valve seat, and a valve body 89" possessing a tapered portion 152 having practically the same angle of gradient as that of the tapered portion 151. It is preferred to produce the valve body 89" by molding a flexible material. As a flexible material, for example, resin or silicone rubber can be used.

Additionally, at a portion at the tapered portion 151of the second cylinder 23", which contacts the valve body 89", a circular protruding portion 103 is formed. Consequently, the second cylinder 23" and the valve body 89" contact each other via this circular protruding portion 103. At this time, because the second cylinder 23" and the valve body 89" contact not by the surfaces but by the circular linear portion at the edge of the protruding portion 103 via the protruding portion 103, high liquidtightness can be accomplished even when manufacturing accuracy of the second cylinder 23" and the valve body 89" has deteriorated.

At the lower end of the valve body 89", a regulating portion 153 is provided. In the regulating portion 153, a dividing groove is provided. By the action of the dividing groove, the regulating portion 153, a dividing groove valve body 89" can be pressed into the opening portion 41" of the second cylinder 23". Additionally, after being pressed into, coming off of the regulating portion from the opening portion 41" can be prevented.

Figure 19:
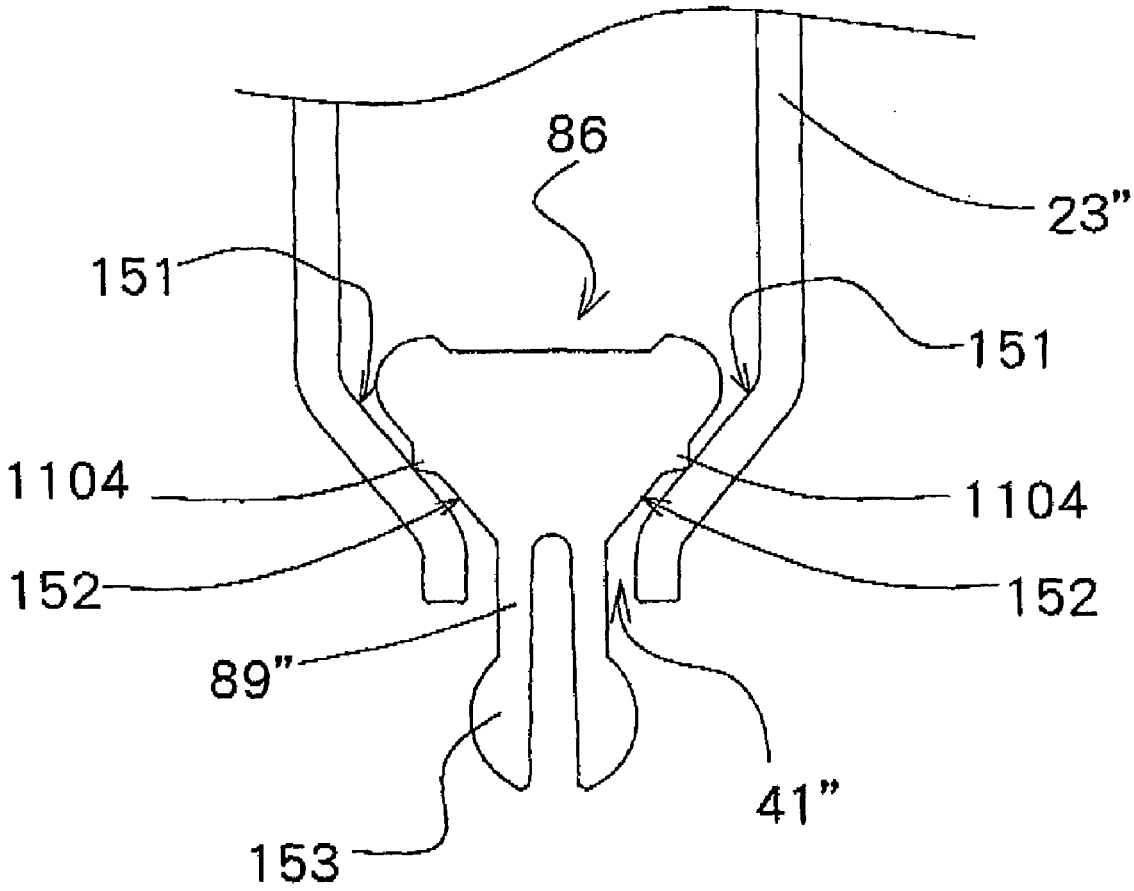
FIGS. 19 is a schematic diagram illustrating an enlarged illustration of the valve mechanism 86 according to another embodiment.

In the above-mentioned embodiment, at a portion at the tapered portion 151 of the second cylinder 23", which contacts the valve body 89", a circular protruding portion 103 is formed. As shown in FIG. 19, it is acceptable to form a circular protruding portion 1104 at a contact portion at the tapered portion 152 of the valve body 89", which contacts the tapered portion 151 of the second cylinder 23".

Liquid discharge motions of the above-mentioned liquid discharge container are described below.

In an initial position, as shown in FIG. 12, and FIG. 13 and FIG.16,by the action of a coil spring 24, momentum is given to the first and the second coupling tubes 81' and 82 in an upward direction, and the contact portion 92' provided at the lower end of the second coupling tube 82 contacts the lower end of the second piston 83 via the protruding portion 1101. Consequently, flow path leading to inside the first and the second coupling tubes 81' and 82 from inside the second cylinder 23" is closed. Additionally, by the empty weight of the valve body 89", as shown in FIG. 18, the tapered portion 152 valve body 89" contacts the tapered portion 151 of the second cylinder 23" via the protruding portion 1101, and the opening portion 41" is closed.

In this position, if the pressing portion 12 at the nozzle head 2 is pressed, as shown in FIG. 14, the first and the second coupling tubes 81' and 82 first descend relatively to the second piston 83. By this motion, the contact portion 92' provided at the lower end of the second coupling tube 82 separates from the lower end of the second piston 83. Consequently, the flow path leading to inside the first and the second coupling tubes 81' and 82 from inside the second cylinder 23" via the opening portion 91 is formed.

If the pressing portion 12 at the nozzle head 2 is further pressed, as shown in FIG. 17, the lower end of the second coupling tube 81' contacts the top surface of the second piston 83 via the protruding portion 1102, and the second piston 83 and the first and the second coupling tubes 81' and 82 descend all together. At this time, inside the second cylinder 23" is pressurized, and as shown in FIG. 18, the opening portion 41" is closed by the valve body 89" contacting the second cylinder 23" via the protruding portion 103. Consequently, the pressurized liquid inside the second cylinder 23" flows out to the nozzle head 2 via the opening 91 and the first and the second hollow coupling tubes 81' and 82, and is discharged from the discharge portion 11.

After the second piston 83 descends until the lower limit of a stroke and if a pressure given to the nozzle head 2 is removed, by the action of the coil spring 24, the first and the second coupling tubes 81' and 82 ascend relatively to the second piston 83. By this motion, as shown in FIG. 15 and FIG. 16, the contact portion 92' provided at the lower end of the second coupling tube 82 contacts the lower end of the second piston 82 via the protruding portion 1101. Consequently, the flow path leading to inside the first and the second coupling tubes 81' and 82 from inside the second cylinder 23" is closed again.

After that, the nozzle head 2, the first and the second coupling tubes 81' and 82 and the second piston 83 ascend all together by the action of the coil spring 24. At this time, because inside the second cylinder 23" is depressurized, the opening portion 41" is opened by the valve body 89" separating from the protruding portion 103 formed at the second cylinder 23", and the fluid flows into the second cylinder 23" from the fluid storing portion 4. When the second piston 83 moves to the upper limit of its elevating stroke, it stops to ascend.

By repeating the above-mentioned motions, discharging the fluid stored in the fluid storing portion 4 from the nozzle head 2 becomes possible.

Figure 20A:
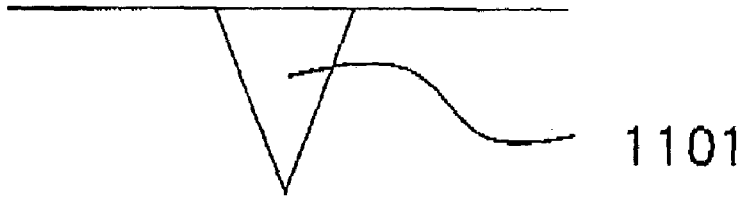
FIGS. 20(A), 20(B), and 20(C) show illustrations of modified versions of the protruding portion 1101.
Figure 20B:
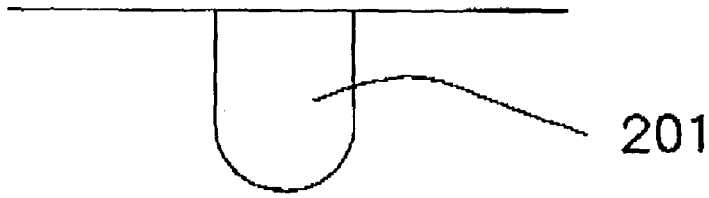
Figure 20C:
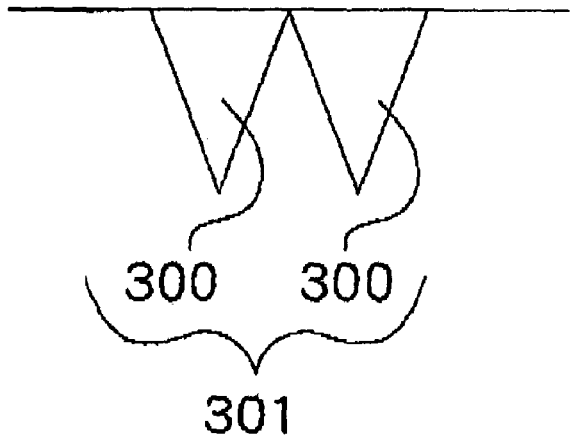

In the above-mentioned embodiment, as shown in FIG. 20(A), as the protruding portions 1101, 1102, 103 and 1104, those having a nearly V-shaped cross-sectional surface are used. As shown in FIG. 20(B), a protruding portion 201 having a nearly U-shaped cross-sectional surface also can be used. As shown in FIG. 20(C), a protruding portion 301 having configuration, in which a pair of circular protrusions 300 are arranged, also can be used.

Additionally, according to the forgoing valve mechanism of a liquid container, by forming a circular protruding portion at either of a valve seat or a valve body, and by contacting the valve seat and the valve body via the circular protruding portion, high liquidtightness can be accomplished while the manufacturing costs of valve mechanisms are kept low.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A liquid-dispensing structure comprising:

an outer cylinder to be filled with a liquid, said outer cylinder having a one-way valve at its lower end to allow a liquid to flow into the outer cylinder;

a hollow piston provided inside the outer cylinder, said piston having a pair of liquid-tight portions formed around its outer circumferential surface, each of which portions liquid-tightly contacts an inner circumferential surface of the outer cylinder, said pair of liquid-tight portions being arranged in positions apart in an axial direction of the outer cylinder, said liquid-tight portions being circular convex portions, wherein one of the pair of liquid-tight portions is provided at an upper end of the piston, and the other of the pair of liquid-tight portions is provided at a lower end of the piston; and an inner cylinder for dispensing the liquid, which reciprocates inside the outer cylinder in an axial direction of the inner cylinder which is co-axial with the outer cylinder, said inner cylinder having a piston-sliding area where when the inner cylinder moves, the piston moves liquid-tightly with respect to the inner cylinder between a lower position and an upper position in the axial direction of the inner cylinder, said inner cylinder having an opening which is closed when the piston is at the lower position and which is opened when the piston is at the upper position wherein the liquid inside the outer cylinder flows into an inside of the inner cylinder through the opening.

2. The liquid-dispensing structure according to claim 1, wherein the liquid-tight portion provided at the upper end is formed with an annular lip extending upward, and the liquid-tight portion provided at the lower end is formed with an annular lip extending downward.

3. The liquid-dispensing structure according to claim 1, wherein the liquid-tight portion at the upper end is formed with two circular convex portions, and the liquid-tight portions at the lower end is formed with one circular convex portion.

4. The liquid-dispensing structure according to claim 1, wherein each liquid tight portion of the piston has a diameter larger than that of the inner circumferential surface of the outer cylinder, and the liquid tight portion is flexible inwardly.

5. The liquid-dispensing structure according to claim 1, wherein the piston has upper and lower circular convex portions along an inner circumferential surface of the piston to close the opening of the inner cylinder, wherein the upper and lower circular convex portions are arranged to locate the opening of the inner cylinder therebetween.

6. The liquid-dispensing structure according to claim 1, wherein the inner cylinder has at least one circular convex portion which is in contact liquid-tightly with the piston at the upper and lower positions in the piston-sliding area.

7. The liquid-dispensing structure according to claim 6, wherein the convex portion of the inner cylinder has a U-shaped or V-shaped cross section.

8. The liquid-dispensing structure according to claim 1, wherein the one-way valve comprises:

a lower surface extending from the inner circumferential surface of the outer cylinder;

a central opening provided in the lower surface; and a valve body movably placed in the central opening, said valve body comprising (i) a head portion provided inside the outer cylinder, said head portion having a larger diameter than the central opening and being fitted on the lower surface to close the opening when the valve body is at a lower position, and (ii) a restraining portion provided outside the outer cylinder, said restraining portion having a larger diameter than the central opening and having grooves to flow the liquid therethrough when the valve body is at an upper position.

9. The liquid-dispensing structure according to claim 8, wherein the lower surface has at least one circular convex portion which is in contact liquid-tightly with the head portion of the valve body at the lower position.

10. The liquid-dispensing structure according to claim 8, wherein the head portion of the valve body has a lower surface having at least one circular convex portion which is in contact liquid-tightly with the lower surface.

11. The liquid-dispensing structure according to claim 1, wherein the one-way valve comprises:

a lower surface extending from the inner circumferential surface of the outer cylinder, said lower surface having at least one opening, through which the liquid flows;

a central tube body provided in the lower surface; and a valve body movably placed in the tube body, said valve body comprising (i) a head portion provided inside the outer cylinder, said head portion being fitted on the lower surface to close the opening when the valve body is at a lower position, and (ii) a restraining portion provided outside the outer cylinder, said restraining portion having a larger diameter than the tube body to prevent the valve body from moving beyond an upper position.

12. The liquid-dispensing structure according to claim 11, wherein the lower surface has at least one circular convex portion which is in contact liquid-tightly with the head portion of the valve body at the lower position.

13. The liquid-dispensing structure according to claim 11, wherein the head portion of the valve body has a lower surface having at least one circular convex portion which is in contact liquid-tightly with the lower surface.

* * * * *

UNITED STATES PATENT AND TRADEMARK OFFICE

CERTIFICATE OF CORRECTION

PATENT NO. : 6,962,273 B2
APPLICATION NO. : 10/443236
DATED : November 8, 2005
INVENTOR(S) : Masatoshi Masuda It is certified that error appears in the above-identified patent and that said Letters Patent is hereby corrected as shown below:

In column 2 at line 65, delete “maybe” and insert -- may be --, therefor.

In column 5 at line 43, after “head” delete “:” and insert -- ; 3:--, therefor.

In column 5 at line 44, after “Pressing portion” insert -- ;--.

In column 5 at line 45, delete “screw” and insert -- Screw --, therefor.

In column 5 at line 49, after “mechanism” insert -- ; --.

In column 5 at line 52, delete “Cylinder” and insert -- Cylindrical --, therefor.

In column 5 at line 55, after “material” insert -- ; --.

In column 5 at line 56, after “screw portion” insert -- ; --.

In column 5 at line 63, after “tube” insert -- ; --.

In column 6 at line 5, after “not” insert -- limited to, the --.

In column 6 at line 9, after “of a” insert -- fluid container --.

In column 7 at line 3, after “FIG. 1” insert -- shows a --.

In column 7 at line 9, after “82” insert -- are --.

In column 7 at line 10, after “FIG. 3,” insert -- to --.

In column 7 at line 31, after “lid 17” insert -- in which a --.

In column 7 at line 32, after “are” insert -- liquidtightly --.

In column 7 at line 34, after “16” insert -- requires a --.

In column 7 at line 56, insert -- The -- before “second”.

In column 8, at line 52, after “82” insert -- and --.

In column 8, at line 56, after “provided” insert -- . --.

In column 10 at line 7, delete “liquid” and insert -- liquidtight --, therefor.

In column 10 at line 9, after “formed” insert -- . At --.

In column 10 at line 10, delete “liquidthight” and insert -- liquidtight --, therefor.

In column 10 at line 17, after “comprises” insert -- a --.

In column 10 at line 35 (Approx.), delete “comprises” and insert -- comprise --, therefor.

In column 10 at line 37 (Approx.), delete “inside” and insert -- and --, therefor.

In column 11 at line 1, delete “in” and insert -- In --, therefor.

UNITED STATES PATENT AND TRADEMARK OFFICE

CERTIFICATE OF CORRECTION

PATENT NO. : 6,962,273 B2
APPLICATION NO. : 10/443236
DATED : November 8, 2005
INVENTOR(S) : Masatoshi Masuda It is certified that error appears in the above-identified patent and that said Letters Patent is hereby corrected as shown below:

In column 12 at line 4, delete “nozzel” and insert -- nozzle --, therefor.

In column 12 at line 13, delete “is” and insert -- in --, therefor.

In column 12 at line 24, delete “in side” and insert -- inside --, therefor.

In column 12 at line 64, after “is” insert -- provided. As --.

In column 13 at line 65, delete “designed” and insert -- described --, therefor.

In column 15 at line 9, after “FIG. 12” insert -- shows a --.

In column 15 at line 11, after “FIG. 15” insert -- are --.

In column 15 at line 31, delete “nozzel” and insert -- nozzle --, therefor.

In column 15 at line 62, delete “the” and insert -- The --, therefor.

In column 16 at line 48, after “FIG. 13,” delete “and”.

In column 17 at line 13, delete “151of” and insert -- 151 of --, therefor.

In column 17 at line 27, after “153” delete, “a dividing groove” and insert -- of the --, therefor.

In column 17 at line 47, after “Consequently,” insert -- a --.

In column 17 at line 51, after “152” insert -- of the --.

Signed and Sealed this

Twenty-second Day of August, 2006

JON W. DUDAS
*Director of the United States Patent and Trademark Office*